US009022871B2

(12) United States Patent
Hirato

(10) Patent No.: US 9,022,871 B2
(45) Date of Patent: May 5, 2015

(54) GAMING MACHINE

(75) Inventor: Jun Hirato, Tokyo (JP)

(73) Assignee: Aruze Gaming America, Inc., Las Vegas, NV (US)

( * ) Notice: Subject to any disclaimer, the term of this patent is extended or adjusted under 35 U.S.C. 154(b) by 1487 days.

(21) Appl. No.: 12/615,910

(22) Filed: Nov. 10, 2009

(65) Prior Publication Data

US 2010/0120540 A1 May 13, 2010

Related U.S. Application Data

(60) Provisional application No. 61/112,935, filed on Nov. 10, 2008, provisional application No. 61/114,166, filed on Nov. 13, 2008.

(51) Int. Cl.
*A63F 13/90* (2014.01)
*G07F 17/32* (2006.01)

(52) U.S. Cl.
CPC ..... *G07F 17/32* (2013.01); *G07F 17/3216* (2013.01)

(58) Field of Classification Search
CPC ..... G07F 17/23; G07F 17/3216
USPC ..... 463/45–47, 30–33
See application file for complete search history.

(56) References Cited

U.S. PATENT DOCUMENTS

| | | | | |
|---|---|---|---|---|
| 2006/0052152 | A1* | 3/2006 | Tedsen et al. | 463/16 |
| 2006/0063591 | A1* | 3/2006 | Gauselmann | 463/30 |
| 2006/0094511 | A1* | 5/2006 | Roireau | 463/46 |
| 2006/0189387 | A1* | 8/2006 | Rigsby et al. | 463/37 |
| 2007/0284814 | A1 | 12/2007 | Hirato et al. | |
| 2007/0287527 | A1 | 12/2007 | Tanabe et al. | |
| 2007/0287528 | A1* | 12/2007 | Hirato et al. | 463/20 |
| 2007/0287538 | A1 | 12/2007 | Ishikawa et al. | |
| 2007/0287543 | A1 | 12/2007 | Tanabe | |
| 2007/0287544 | A1 | 12/2007 | Hirato et al. | |
| 2008/0004099 | A1 | 1/2008 | Ikeda | |
| 2008/0153569 | A1 | 6/2008 | Tanabe | |
| 2008/0207303 | A1* | 8/2008 | Rasmussen | 463/20 |
| 2009/0174346 | A1* | 7/2009 | Hwang et al. | 315/294 |

* cited by examiner

*Primary Examiner* — Ronald Laneau
*Assistant Examiner* — Ross Williams
(74) *Attorney, Agent, or Firm* — Lexyoume IP Meister, PLLC

(57) ABSTRACT

A gaming machine has sticker pasting portions onto which stickers with decorative images are pasted, around each of a plurality of displays thereof. Each sticker pasting portion has a sticker pasting surface and a raised portion. Owing to stickers pasted onto sticker pasting portions, the gaming machine harmonizes with an atmosphere of a game arcade.

5 Claims, 14 Drawing Sheets

GAMING MACHINE

CROSS-REFERENCE TO RELATED APPLICATIONS

This application is based upon and claims a priority from the U.S. provisional Patent Application No. 61/112,935 filed on Nov. 10, 2008, the U.S. provisional Patent Application No. 61/114,166 filed on Nov. 13, 2008, the entire contents thereof are incorporated herein by reference.

BACKGROUND OF THE INVENTION

1. Field of the Invention

A gaming machine according to one or more aspects of the present invention relates to a gaming machine having a display for displaying information concerning a game.

2. Description of Related Art

There have conventionally been installed various types of gaming machines in game arcades. Gaming machines are designed in different concepts depending on types of gaming machines. That is, gaming machines are likely to express features and game contents of their own by applying suggestive exterior design.

Meanwhile, a distinctive atmosphere of a game arcade may be created by unifying interior decorations thereat (for instance, furniture and wallpaper). In this case, the distinctive atmosphere can be one of appealing factors of the game arcade. Some players may choose a game arcade to play in after observing the atmosphere of the game arcade.

As described in the above, gaming machines to be installed in game arcades are designed based on their own game concepts. Accordingly, players may get weird impression on the contrast of exterior design of gaming machines and an atmosphere created by interior decorations around the game arcade. Therefore, there has been desired to devise a gaming machine capable of harmonizing with an atmosphere of a game arcade.

The object of the present invention is to provide a gaming machine capable of harmonizing with an atmosphere of a game arcade.

Also, in gaming machines such as slot machines, roulette game machines or card game machines using coins or the like as gaming media, players start a predetermined game by inserting coins in such gaming machines. At this time, displays provided in such gaming machines display identification patterns (for instance, images of the reels in the case of slot machines, images of the wheel in the case of roulette game machines, or images of cards in the case of card game machines) and game images concerning the game, such as effect screens and the like. The displays provided in such gaming machines also display lottery results of lotteries carried out in the gaming machines.

To make the display screens in such gaming machines easier for the players to see, the display surfaces of such displays may also be arranged at a tilt with respect to a horizontal direction or a vertical direction. As the body frame and the posture in playing the game differ depending on the player, the position and the direction of the line of sight at the time of viewing the display surface differ depending on the player. Accordingly, it was impossible to provide gaming machines having display surfaces which are slanted at an inclination angle suitable for all players.

In recent years, gaming machines which have a plurality of displays have been produced. In the case of such gaming machines provided with a plurality of displays, all these displays need to be made visible to the players. In this case, the direction of the line of sight in the case the players view the displays differs depending on each of the plurality of displays. Accordingly, to make all the screens displayed on the plurality of displays easier for the players to see, setting of the inclination angle for the display surface in each display becomes very important.

Other object of the present invention is to provide a gaming machine having a plurality of displays wherein the display screens of any of the displays can be arranged at a proper inclination angle allowing easy view thereof by the player, and the height of the gaming machine can be reduced, expanding the player's visual range.

SUMMARY

The gaming machine according to one or more aspects of the present invention comprising: a cabinet that houses a processor for executing game-related control; a display that is arranged on a front face of the cabinet and displays game-related information; and a sticker pasting portion that is formed on the front face of the cabinet so that a sticker with a decorative image is pasted thereon, wherein the sticker pasting portion comprises: a sticker pasting surface onto which the sticker is pasted; and a raised portion that is formed around periphery of the sticker pasting surface so as to be raised by predetermined height with reference to a surface level of the sticker pasting surface.

By changing stickers to be pasted onto the sticker pasting portions, the gaming machine thus harmonizes with an atmosphere of a game arcade where the gaming machine is installed. Further, a sticker is cheaper than a decorative panel or the like. Accordingly, the gaming machine is capable of harmonizing with the atmosphere of the game arcade at lower cost. Further, by forming the raised portion on the sticker pasting portion, the gaming machine prevents a third person from peeling off the sticker.

The gaming machine according to one or more aspects of the present invention comprising: a cabinet that houses a processor for executing game-related control; a display that is arranged on a front face of the cabinet and displays game-related information; and a sticker pasting portion that is formed around the display on the front face of the cabinet so that a sticker with a decorative image is pasted thereon; a light emitting device that is arranged on a side surface of the display and emits light from the side surface of the display; and a reflector that is arranged so as to face the light emitting device beyond the sticker pasting portion and reflects light emitted from the light emitting device, wherein the sticker pasting portion comprises: a sticker pasting surface that is a surface onto which the sticker is pasted and is situated closer to the front face of the cabinet than a light axis from the light emitting device to the reflector is situated; and a raised portion that is formed around periphery of the sticker pasting surface so as to be raised from a surface level of the sticker pasting surface by height that is higher than thickness of the sticker.

Similarly with the foregoing gaming machines, the gaming machine of this aspect harmonizes with an atmosphere of a game arcade where the gaming machine is installed. Further, the gaming machine is capable of harmonizing with the atmosphere of the game arcade at lower cost. Further, the sticker pasting portion has the sticker pasting surface and the raised portion, wherein the raised portion is raised from a surface level of the sticker pasting surface by height that is higher than the thickness of the sticker. Accordingly, the gaming machine more strictly prevents a third person from peeling off the sticker. In the gaming machine, the reflector is arranged on a side surface of the display. Further, the sticker pasting surface is situated closer to the front of the cabinet than a light axis from the light emitting device to the reflector is situated. Accordingly, the irradiation light from the light emitting device lights up the sticker pasted onto the sticker pasting surface. That is, the above-mannered lighting by the light emitting device enables the gaming machine to give the player a strong impression regarding features of the gaming machine expressed with the sticker (e.g., design) and game contents. Further, the reflector reflects the irradiation light from the light emitting device. Due to reflected light by the reflector, the player is strongly aware of the vicinity of the reflector. The sticker pasting surface is situated between the display and the reflector. Accordingly, the sticker pasted onto the sticker pasting surface naturally comes into the player's sight. As a result, the gaming machine gives the player a strong impression regarding features of the gaming machine expressed with the sticker (e.g., design) and game contents.

Therefore, in order to achieve the above object, according to a gaming machine of the invention encompassing one or more aspects thereof, there is provided a gaming machine. A gaming machine comprises a cabinet; a first display arranged in the cabinet and including a first display surface for displaying information with respect to a game; and a second display arranged above the first display in the cabinet and including a second display surface for displaying information with respect to the game. The first display surface is arranged in the cabinet slantwise at a first predetermined angle with respect to a perpendicular direction so that a lower end of the first display surface is positioned further frontward of the gaming machine than an upper end thereof. The second display surface is arranged in the cabinet slantwise at a second predetermined angle with respect to the perpendicular direction so that a lower end of the second display surface is positioned further frontward of the gaming machine than an upper end thereof, the second predetermined angle having a smaller inclination angle than the first predetermined angle. Thus, the display surfaces of a plurality of displays provided in the gaming machine can be arranged at a suitable inclination angle making these easier for the players to see. The height of the gaming machine can thus be reduced, expanding the players' visual range.

One or more of the above aspects of the invention will be more fully described in the following detailed description when read in connection with the accompanying drawings. It is to be expressly understood, however, that the drawings are for purpose of illustration only and not intended as a definition of the limits of the invention.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention.

DETAILED DESCRIPTION

Figure 1:
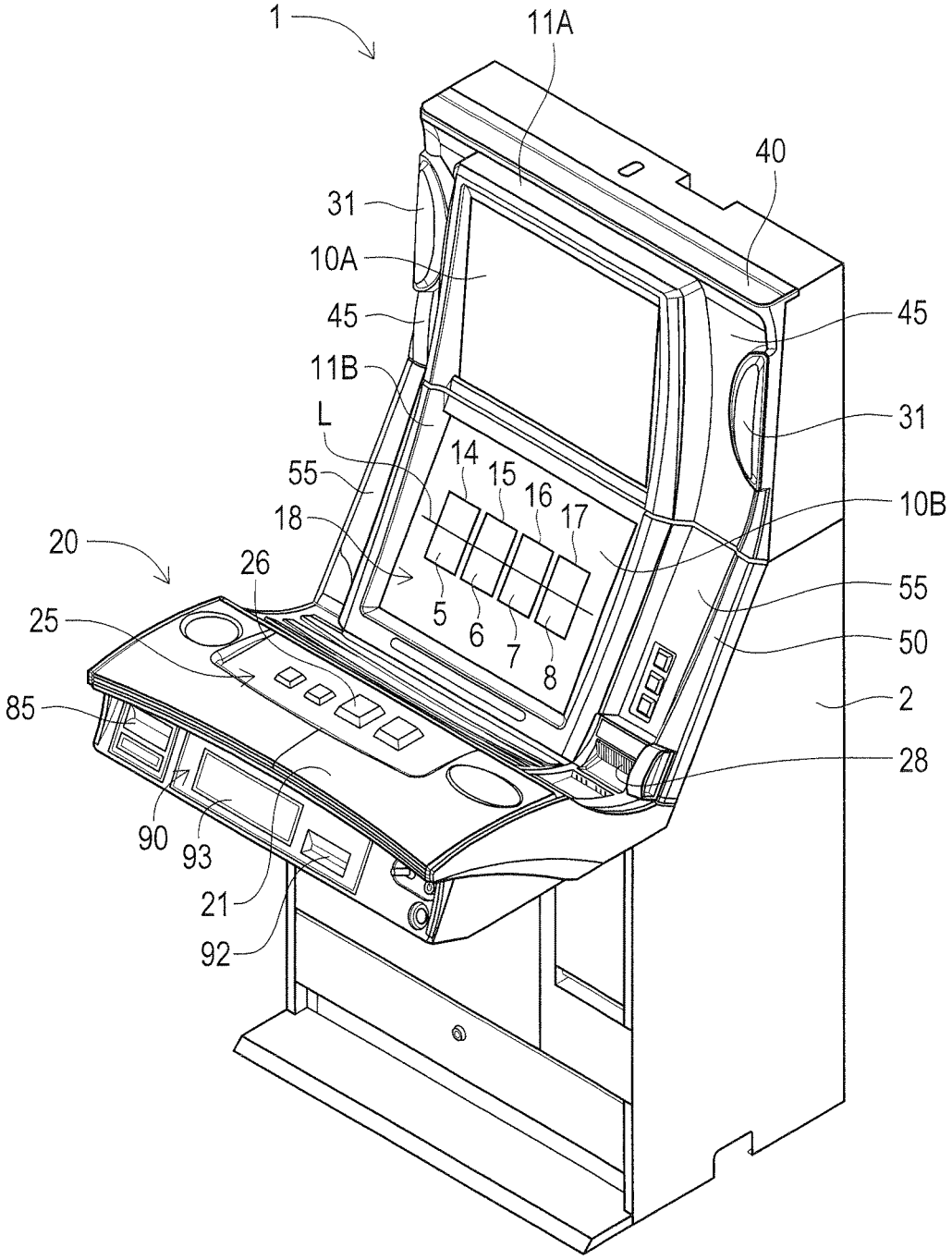
FIG. 1 is a view for illustrating features of a slot machine 1 according to the first embodiment of the present invention.

The various aspects summarized previously may be embodied in various forms. The following description shows by way of illustration of various combinations and configurations in which the aspects may be practiced. It is understood that the described aspects and/or embodiments are merely examples, and that other aspects and/or embodiments may be utilized and structural and functional modifications may be made, without departing from the scope of the present disclosure.

It is noted that various connections are set forth between items in the following description. It is noted that these connections in general and, unless specified otherwise, may be direct or indirect and that this specification is not intended to be limiting in this respect.

A gaming machine according to one or more aspects of the invention will be described in detail with reference to the drawings based on an embodiment embodying one or more aspects of the invention. However, it is appreciated that one or more aspects of the present invention may be embodied in distributable (via CD and the like) or downloadable software games, console games, and the like. In this regard, the gaming machine may be a virtual gaming machine that is displayed on a multi-purpose computer and/or dedicated kiosk. Aspects of the invention are described by way of hardware elements. However, it is appreciated that these elements may also be software modules that are executable in a computer. The software modules may be stored on a computer readable medium, including but not limited to a USB drive, CD, DVD, computer-readable memory, tape, diskette, floppy disk, and the like. For instance, aspects of the invention may be embodied in a JAVA-based application or the like that runs in a processor or processors. Further, the terms "CPU", "processor", and "controller" are inclusive by nature, including at least one of hardware, software, or firmware. These terms may include a portion of a processing unit in a computer (for instance, in multiple core processing units), multiple cores, a functional processor (as running virtually on at least one of processor or server, which may be local or remote). Further, in network-based gaming systems, the processor may include only a local processor, only a remote server, or a combination of a local processor and a remote server.

It is contemplated that one or more aspects of the invention may be implemented as computer executable instructions on a computer readable medium such as a non-volatile memory, a magnetic or optical disc. Further, one or more aspects of the invention may be implemented with a carrier signal in the form of, for instance, an audio-frequency, radio-frequency, or optical carrier wave.

Hereinafter, the gaming machine according to the invention will now be described in detail in first and second embodiments relating to a gaming machine, while referring to the drawings.

First Embodiment

A gaming machine according to the first embodiment will be described in detail while referring to the drawings as embodied in a slot machine 1.

There will firstly be described on features of the slot machine 1 according to the present invention while referring to the drawings. The slot machine 1 according to the first embodiment is a so-called hybrid-type slot machine. In this hybrid-type slot machine, a heretofore known transparent liquid crystal panel is arranged in front of a plurality of rotatably-supported mechanical reels. In the hybrid-type slot machine, the transparent liquid crystal panel turns into a transparent state when a game is executed so as to visibly display various symbol images depicted on peripheral surfaces of the mechanical reels.

Figure 2:
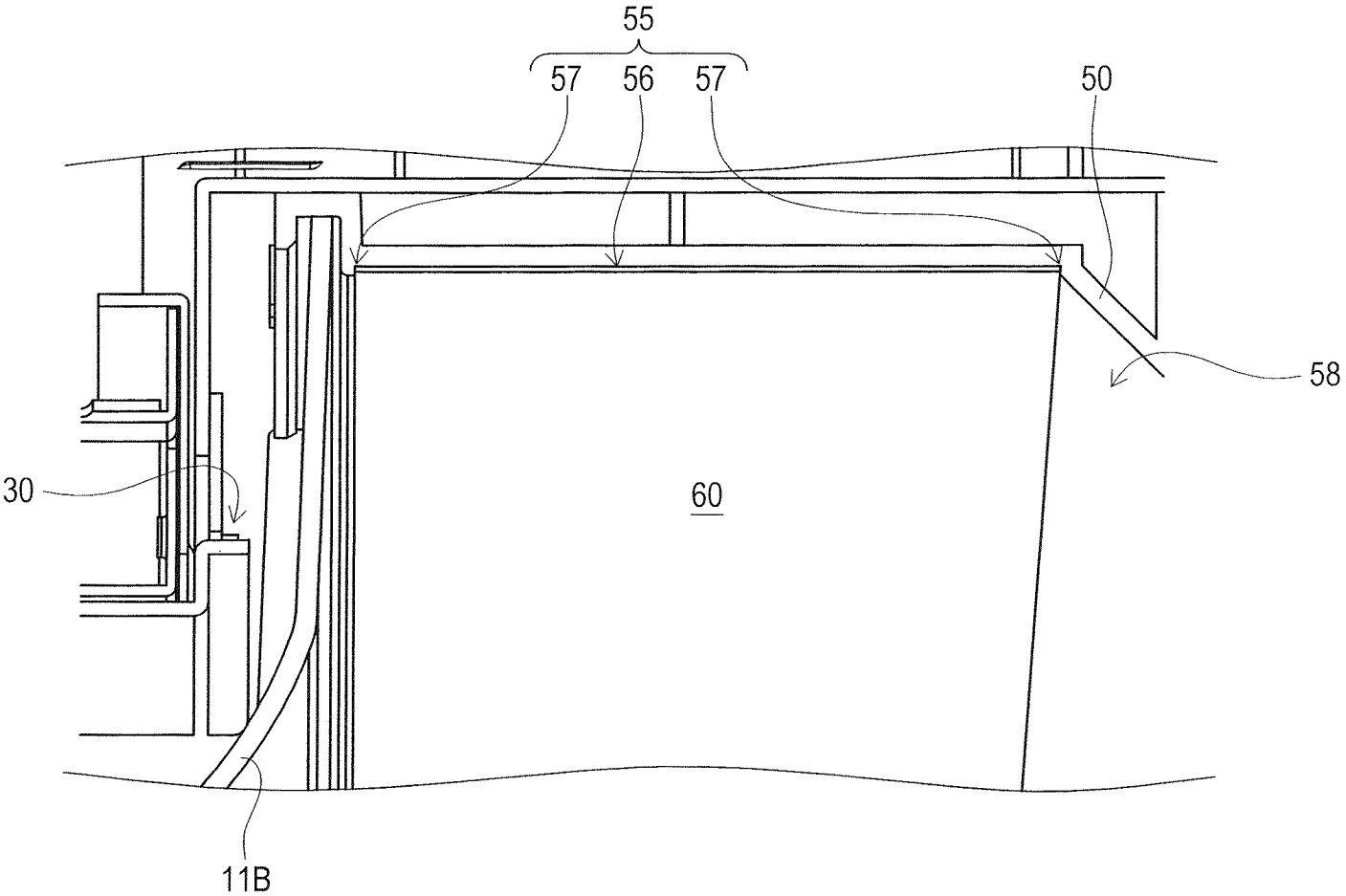
FIG. 2 is a cross sectional view of an example of a sticker pasting portion according to the first embodiment of the present invention.

Further, the slot machine 1 is a slanted-type slot machine to be installed in a game arcade such as casino (refer to FIG. 1 and FIG. 2). In case of playing game with a slanted-type slot machine, a player is to sit on a chair provided in front of the slot machine.

The slot machine 1 according to the first embodiment has a cabinet 2. The cabinet 2 has an upper front cover member 40 and a front cover member 50 on a front part thereof. The upper front cover member 40 is arranged at a front upper part of the cabinet 2. An upper display 10A is arranged on a substantial center of the upper front cover member 40. Further, the front cover member 50 is arranged at a middle front part of the cabinet 2. A main display 10B is arranged on a substantial center of the front cover member 50.

As shown in FIG. 1, the upper front cover member 40 has a pair of first sticker pasting portions 45. The pair of first sticker pasting portions 45 are formed at both sides (i.e., left side and right side) of the upper display 10A. Each of the first sticker pasting portions 45 has a sticker pasting surface 46 and a raised portion. A sticker 60 with predetermined design is pasted onto a sticker pasting surface 46. A shape of the sticker 60 is the same as that of the sticker pasting surface 46. The raised portion of the first sticker pasting portion 45 is formed around a periphery of the sticker pasting surface 46 so as to be raised by predetermined height with reference to the level of the sticker pasting surface 46.

Similarly with the upper front cover member 40, the front cover member 50 has a pair of second sticker pasting portions 55 (refer to FIG. 1). The pair of second sticker pasting portions 55 are formed at both sides (i.e., left side and right side) of the main display 10B. Each of the second sticker pasting portions 55 has a sticker pasting surface 56 and a raised portion 57. A sticker 60 with predetermined design is pasted onto a sticker pasting surface 56. A shape of the sticker 60 is the same as that of the sticker pasting surface 56. The raised portion 57 is formed around a periphery of the sticker pasting surface 56 so as to be raised by predetermined height with reference to the level of the sticker pasting surface 56.

Accordingly, by changing stickers 60 to be pasted onto the first sticker pasting portions 45 and the second sticker pasting portions 55, the slot machine 1 may easily harmonize with an atmosphere of a game arcade where the slot machine 1 is installed. Further, each sticker pasting portion includes a raised portion around a periphery of its sticker pasting surface. The raised portion is formed so as to be raised by predetermined height with reference to the level of the sticker pasting surface. That is, the raised portion is positioned closely to each edge of the sticker pasted on the sticker pasting surface. Thereby, a third person cannot catch an edge of the sticker easily. As a result, the slot machine 1 prevents a third person from peeling off a sticker intentionally.

Next, the slot machine 1 according to the first embodiment will be described in detail while referring to the drawings. As shown in FIG. 1, the slot machine 1 has the cabinet 2. The cabinet 2 houses electrical and mechanical components for executing predetermined game aspects in the slot machine 1. The electrical and mechanical components include reels and a control board to be described later. For instance, a control board is housed at a lower part of the cabinet 2. The control board includes a processor and the like and plays an important role for controlling the slot machine 1.

Further, four reels (specifically, a first reel 5, a second reel 6, a third reel 7 and a fourth reel 8) are provided inside the cabinet 2 in a freely rotating fashion. The first reel 5 through the fourth reel 8 each have a symbol string drawn on an outer peripheral surface thereof. Each symbol string includes a plurality of types of symbols.

As was earlier described, the cabinet 2 has the upper front cover member 40 at the front upper part thereof. That is, the upper front cover member 40 constitutes the front upper part of the cabinet 2. Further, the upper front cover member 40 has a pair of first sticker pasting portions 45 and a pair of reflectors 48. The upper display 10A is arranged on the substantial center of the upper front cover member 40. The upper display 10A is made up of a heretofore known liquid crystal panel. The upper display 10A is arranged so as to stick out from the surface of the upper front cover member 40, i.e., frontward with respect to the cabinet 2 (refer to FIG. 5 and FIG. 6). The upper display 10A displays information with respect to the game to be played. The display contents to be displayed on the upper display 10A include effect images, introduction of the game contents, game rule explanations, and the like. Further, the upper display cover member 11A is arranged on the upper display 10A. The upper display cover member 11A covers side surfaces of the upper display 10A. The upper display cover member 11A is made of a resin material or the like. The upper display cover member 11A has a pair of light transmissive portions 12 at its sides facing side surfaces of the upper display 10A (specifically, positions that face a pair of light emitting devices 30 to be described later). The light transmissive portions 12 are made of a light transmissive material (e.g., translucent acrylic or the like).

Figure 5:
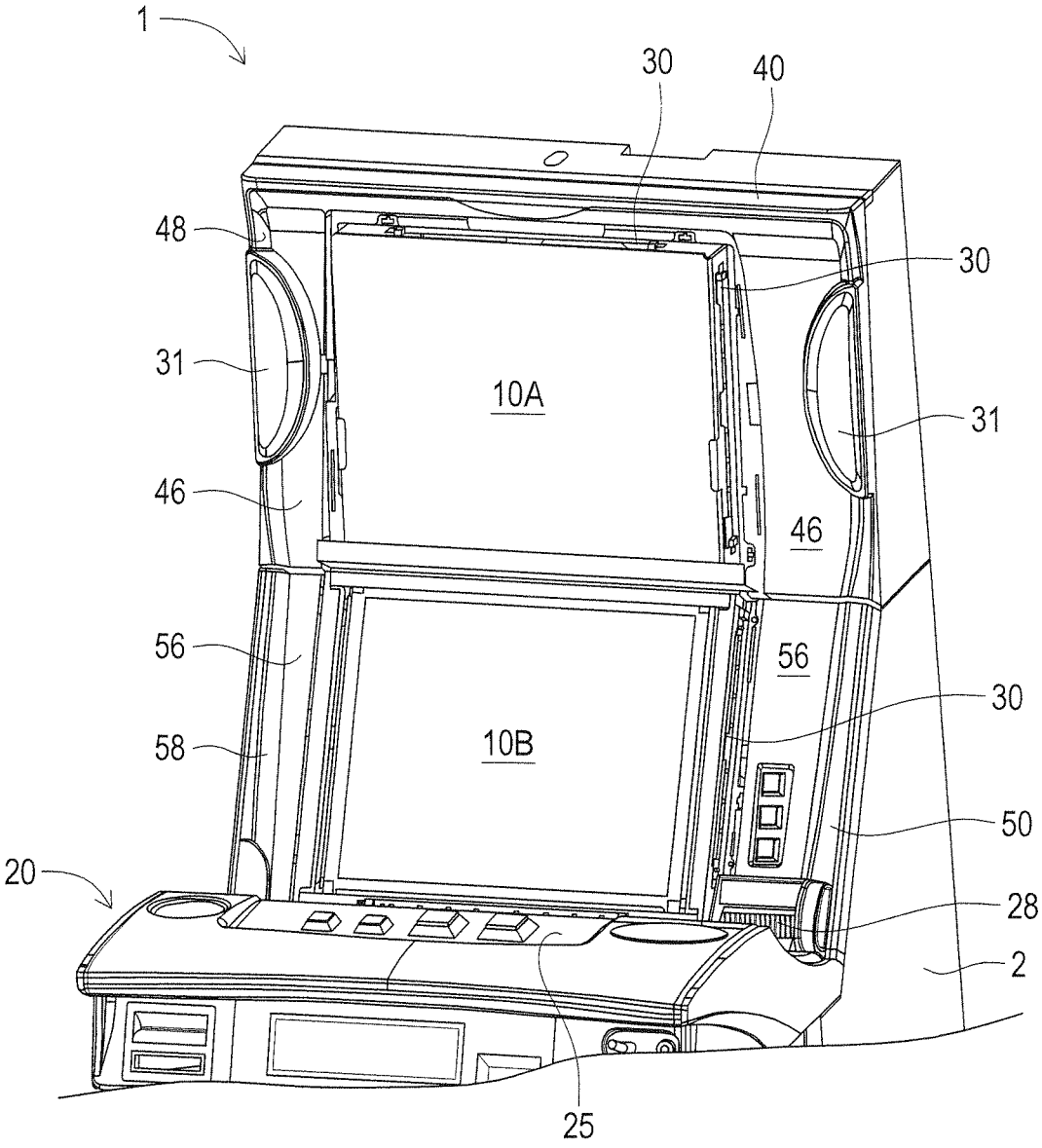
FIG. 5 is a view for illustrating positions of light emitting devices according to the first embodiment of the present invention.

As shown in FIG. 1 and FIG. 5, the cabinet 2 has the front cover member 50 at the front middle part thereof. That is, the front cover member 50 constitutes the front middle portion of the cabinet 2. Further, the front cover member 50 has a pair of second sticker pasting portions 55 and a pair of reflectors 58. The main display 10B is arranged on the substantial center of the front cover member 50. The main display 10B is made up of a heretofore known liquid crystal panel. The main display 10B displays a game progress state. That is, a player makes progress on a game with the slot machine 1 based on display contents of the main display 10B. Further, the main display cover member 11B is set on the main display 10B. The main display cover member 11B covers side surfaces of the main display 10B. The main display cover member 11B is made of a resin material or the like. The main display cover member 11B has a pair of light transmissive portions 12 at its sides facing side surfaces of the main display 10B (specifically, positions that face a pair of light emitting devices 30 to be described later). The light transmissive portions 12 are made of a light transmissive material (e.g., translucent acrylic or the like).

Peripheral structure of the upper display 10A and the main display 10B will be described in detail later by referring to drawings.

The main display 10B has a first display window 14, a second display window 15, a third display window 16 and a fourth display window 17. As described earlier, the first reel 5 through the fourth reel 8 are arranged inside the cabinet 2. The main display 10B is positioned in front of the first reel 5 through the fourth reel 8. In the main display 10B, the first display window 14 through the fourth display window 17 are formed at portions corresponding to the first reel 5 through the fourth reel 8. For instance, the first display window 14 is formed at a position corresponding to the front of the first reel 5 of the main display 10B. In the slot machine 1, the inner side of the first display window 14 through the fourth display window 17 can be changed to a transparent state. This enables a player to view an inside of the main display 10B trough the first display window 14 through the fourth display window 17. Specifically, the player can see the symbols drawn on the first reel 5 though the fourth reel 8 via the first display window 14 through the fourth display window 17.

Further, the main display 10B displays one pay line L (refer to FIG. 1). The pay line L crosses the center of the first display window 14 though the fourth display window 17 in a horizontal fashion. The pay line L defines a symbol combination constituting the game results. Accordingly, if the symbol combination which has been repositioned on the pay line L is a predetermined winning combination, the slot machine 1 awards a payout in accordance with this combination and the credit amount (bet amount) thus bet.

In the present invention, the number of reels is not limited to four reels. Specifically, the number of reels in the slot machine 1 can be changed to a different number.

Further, a touch panel 18 is provided at a front face of the main display 10B (refer to FIG. 1). Accordingly, the player can operate the touch panel 18 to input various types of commands. For instance, the players can select a desired selection from a plurality of selections which are displayed on the main display 10B, by depressing the touch panel 18 with a finger.

Further, a pair of light emitting devices 30 are arranged at side surface portions of the upper display 10A (refer to FIG. 5). Each light emitting device 30 is made up of plural LEDs (i.e., Light Emitting Diodes) arranged in a row. The light emitting devices 30 are arranged on side surfaces of the upper display 10A so that LEDs of the light emitting devices 30 are arranged perpendicularly to the respective side surfaces of the upper display 10A. As described earlier, the side surface portions of the upper display 10A are covered by the upper display cover member 11A. That is, the light emitting devices 30 are also covered by the upper display cover member 11A. In this connection, the upper display cover member 11A has a pair of light transmissive portions 12. The light transmissive portions 12 are formed at positions facing LEDs constituting the respective light emitting devices 30. Accordingly, light from a light emitting device 30 is mainly emitted toward a side-end direction of the cabinet 2 (i.e., toward a reflector 48) via a light transmissive portion 12 formed on the upper display cover member 11A (refer to FIG. 6). In the first embodiment, a light path which directs from a light emitting device 30 to a reflector 48 is termed a light axis A.

Similarly with the upper display 10A, a pair of light emitting devices 30 are arranged at side surface portions of the main display 10B (refer to FIG. 5). Each light emitting device 30 for the main display 10B is also made up of plural LEDs (i.e., Light Emitting Diodes) arranged in a row. The light emitting devices 30 are arranged on side surfaces of the main display 10B so that LEDs of the light emitting devices 30 are arranged perpendicularly to the respective side surfaces of the main display 10B. As described earlier, the side surface portions of the main display 10B are covered by the main display cover member 11B. That is, the light emitting devices 30 are also covered by the main display cover member 11B. In this connection, the main display cover member 11B has a pair of light transmissive portions 12. The light transmissive portions 12 are formed at positions facing to LEDs constituting the respective light emitting devices 30. Accordingly, light from a light emitting device 30 is mainly emitted toward a side-end direction of the cabinet 2 (i.e., toward a reflector 58) via a light transmissive portion 12 formed on the main display cover member 11B (refer to FIG. 6). In the first embodiment, a light path which directs from a light emitting device 30 to a reflector 58 is termed a light axis A.

A bill slot 28 is formed at a front face of the cabinet 2. The bill slot 28 is adapted to accept bills inside the cabinet 2. At the slot machine 1, the player can insert a predetermined ticket in the bill slot 28. Such a ticket is outputted from a ticket printer 85 as will be described later. This ticket includes information with respect to the amount of gaming values awarded to the player based on the game results. Specifically, the slot machine 1 can identify the amount of gaming values which can be used in the game based on the gaming value amount information included in such a ticket.

In the slot machine 1 according to the first embodiment, bills, tickets or electronic valuable information (credits) corresponding to these can be used as gaming values. The gaming values applicable to this invention are not limited to these. For instance, coins, medals, tokens, electronic money, tickets or the like can also be employed.

As shown in FIG. 1, the slot machine 1 has speakers 31. The speakers 31 are provided at a front face of the cabinet 2. The speakers 31 are provided as a pair at a right side and a left side of the upper display 10A. Speakers 31 output sound in accordance with the progress of the game.

As described earlier, the slot machine 1 has an armrest 20. The armrest 20 is formed so as to stick out from a front face of the cabinet 2 toward the player (i.e., frontward for the slot machine 1). More specifically, the armrest 20 is formed at a lower part of the main display 10B. The player seated in front of the slot machine 1 can play the game while resting his/her arms on the armrest 20. His/her arms on the armrest 20 are situated at position higher than the lower end of the main display 10B.

The arm rest 20 is furnished with an upper panel 21, a control panel 25, a ticket printer 85, a player information obtaining device 90 and a woofer. As shown in FIG. 1, the upper panel 21 and the control panel 25 are arranged on the top face of the armrest 20. The upper panel 21 is a portion where the player's arms or the like come in contact. The upper panel 21 is situated at position higher than the lower end of the main display 10B (refer to FIG. 1). Accordingly, when putting his/her arms on the upper panel 21, the player views the main display 10B in a looking-down posture. The control panel 25 is arranged at the side of the main display 10B, on the top face of the armrest 20. The control panel 25 is made up of a plurality of operation buttons 26. The plurality of operation buttons 26 include a BET button, a COLLECT button, a START button, a CASHOUT button and the like. The control panel 25 is used by the player to carry out operations in the game. Therefore, the player can carry out operations in the game with the control panel 25 and the touch panel 18 while resting his/her arms on the upper panel 21.

The woofer is arranged inside the armrest 20. The woofer is a speaker specialized in low-pitched sound output. Accordingly, the slot machine 1 is capable of carrying out sound effect with low-pitched sound output depending on progress of the game.

The ticket printer 85 and the player information obtaining device 90 are arranged on a front face of the armrest 20. The ticket printer 85 outputs the amount of gaming value the player possesses onto a ticket before the game of the slot machine 1 is put to an end. As described earlier, the thus outputted ticket can be inserted in the bill slot 28. The player information obtaining device 90 includes a card reader 92 and an information display 93. The card reader 92 carries out data-read/write operation for a player card. The player card is a recording medium onto which player information is recorded. Player information refers to game-related information of a player who possesses the player's card (e.g., information relating to game result history). The information display 93 displays player information read by the card reader 92. Accordingly, the player can grasp his/her own player information by having a look at display contents of the player information obtaining device 90. It is to be noted that the player information obtaining device 90 is called a PTS (Player Tracking System).

Next, there will be described configuration of a sticker pasting portion onto which a sticker 60 is pasted, while referring to drawings. As described earlier, a pair of first sticker pasting portions 45 are formed on the left side and the right side of the upper display 10A arranged on the upper front cover member 40 (refer to FIG. 1). Further, a pair of second sticker pasting portions 55 are formed on the left side and the right side of the main display 10B arranged on the front cover member 50 (refer to FIG. 1). In the first embodiment, basic structure of the first sticker pasting member 45 is the same as that of the second sticker pasting portion 55. Therefore, as an example of a sticker pasting portion (i.e., first sticker pasting portion 45 and second pasting portion 55), here will be taken and described about the configuration of a second sticker pasting portion 55 on the right side of the main display 10B.

The second sticker pasting portion 55 shown in FIG. 2 is formed so as to adjoin the right side of the main display 10B. As described earlier, side surface portions of the main display 10B are covered with the main display cover member 11B. That is, the second sticker pasting portions 55 is formed on the front cover member 50 so as to adjoin the main display cover member 11B (refer to FIG. 2).

The second sticker pasting portion 55 consists of a sticker pasting surface 56 and a raised portion 57. As shown in FIG. 2, the sticker pasting surface 56 is a portion onto which a sticker 60 with a decorative image is pasted. The surface of the sticker pasting surface 56 is formed to be smooth. Accordingly, a contact area between the sticker 60 and the sticker pasting surface 56 is secured sufficiently. As a result, the sticker 60 is reliably pasted onto the sticker pasting surface 56. It is desired that the sticker 60 should have a decorative image that harmonizes with an atmosphere of a game arcade where the slot machine 1 is installed. In the first embodiment, thickness of the sticker 60 is termed sticker thickness S.

As shown in FIG. 2, the raised portion 57 is formed around the periphery of the sticker pasting surface 56. The raised portion 57 is raised by predetermined height with reference to the level of the sticker pasting surface 56. In the first embodiment, the height of the raised portion 57 with reference to the level of the sticker pasting surface 56 (i.e., raised amount of the raised portion 57) is termed raised height D.

As earlier described, a shape of the sticker 60 to be pasted onto the sticker pasting surface 56 is the same as that of the sticker pasting surface 56. Accordingly, when the sticker 60 is pasted onto the sticker pasting surface 56, edges of the sticker 60 contact the side surfaces of the raised portion 57 (refer to FIG. 3 and FIG. 4). In case of peeling off the sticker 60, one of edges of the sticker 60 is peeled off from the sticker pasting surface 56 by scratching the edge with a nail or the like. Thereafter, the sticker 60 is peeled off by pulling the peeled edge. In this connection, in the first embodiment, the edges of the sticker and the side surfaces of the raised portion 57 fittingly contact each other. Therefore, there are no spaces to allow scratching an edge of the sticker 60. Accordingly, the slot machine 1 prevents a third person from peeling off the sticker 60 intentionally.

Figure 3:
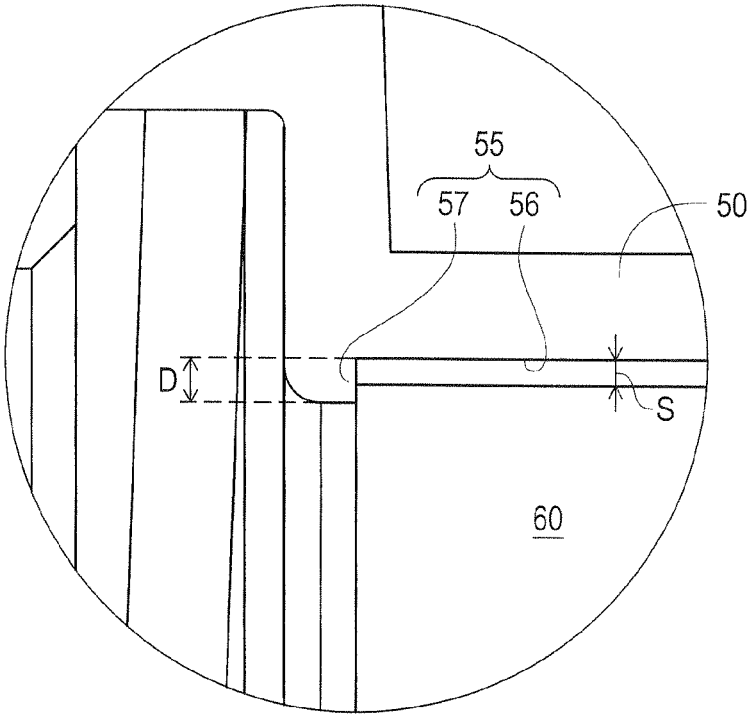
FIG. 3 is a view (1) for illustrating a side end portion of the sticker pasting portion according to the first embodiment of the present invention.
Figure 4:
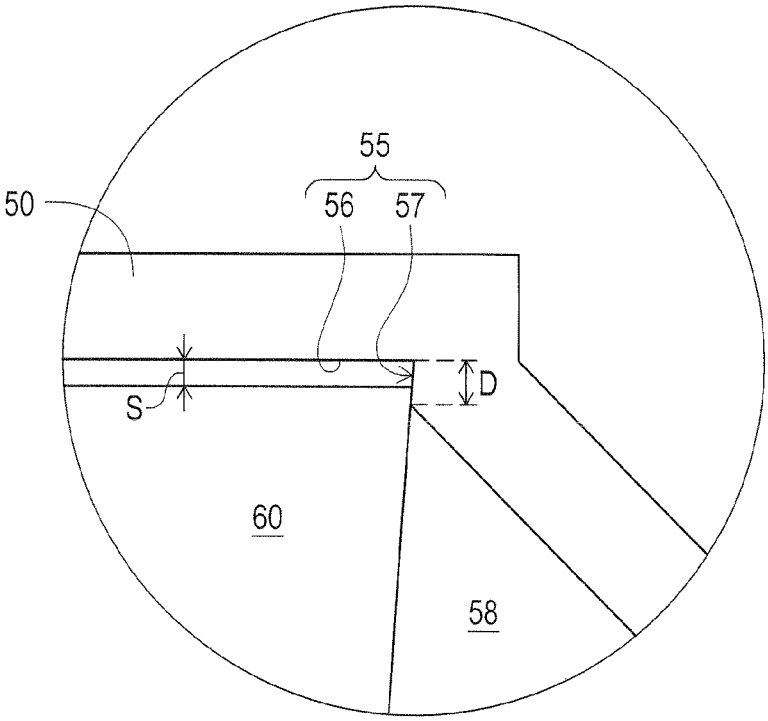
FIG. 4 is a view (2) for illustrating a side end portion of the sticker pasting portion according to the first embodiment of the present invention.

As shown in FIG. 3 and FIG. 4, the height of the raised portion 57 (i.e., raised height D) is higher than the thickness of the sticker 60 (i.e., sticker thickness S). The raised portion 57 is formed along the edges of the sticker 60 (i.e., the periphery of the sticker pasting surface 56). In case of peeling off the sticker 60, a third person is highly likely to catch and scratch an edge of the sticker 60 from outside so as to apply force to inside of the sticker 60. In this connection, in the first embodiment, the raised height D is made higher than the sticker thickness S. Therefore, a nail of a third person or the like only reaches the surface of the sticker 60 without catching an edge of the sticker 60 pasted onto the sticker pasting surface 56. That is, even though the third person attempts to peel off the sticker 60 intentionally, the slot machine 1 may protect an edge of the sticker 60 from a nail of the third person or the like. Thereby, the slot machine 1 prevents the third person from peeling off the sticker 60. As a result, the slot machine 1 is capable of keeping the state of harmonizing with an atmosphere of a game arcade.

In the example taken in the above, the description has been given on the second sticker pasting portion 55 at the right side of the main display 10B. In this connection, the second sticker pasting portion 55 at the left side of the main display 10B also exhibits effect the same as the foregoing sticker pasting portion 55.

Further, the configuration of the first sticker pasting portion 45 is the same as that of the second sticker pasting portion 55. That is, the first sticker pasting portion 45 consists of a sticker pasting surface 46 and a raised portion. The raised portion is formed along the periphery of the sticker pasting surface 46. Further, raised height D of the raised portion is made higher than sticker thickness S of the sticker 60 to be pasted onto the sticker pasting surface 46. Accordingly, the first sticker pasting portions 45 at the right side and the left side of the upper display 10A also exhibit effect the same as the foregoing sticker pasting portion 55.

Next, there will be described on a pair of reflectors 48 and a pair of reflectors 58 formed on the upper front cover member 40 and the front cover member 50, respectively, while referring to drawings. As described earlier, a pair of light emitting devices 30 and the other pair of light emitting devices 30 are arranged on the side surface portions of the upper display 10A and those of the main display 10B, respectively (refer to FIG. 5).

The pair of light emitting devices 30 on the side surface portions of the upper display 10A are covered with the upper display cover member 11A which is partially made of a light transmissive material. The upper display cover member 11A has a pair of light transmissive portions 12 at its side portions facing the respective light emitting devices 30. The light transmissive portions 12 are made of a light transmissive material (e.g., translucent acrylic or the like). Accordingly, light of a light emitting device 30 is not blocked by the upper display cover member 11A. A light emitting device 30 emits light mainly toward a side-end direction of the slot machine 1. Light a light emitting device 30 emits is termed irradiation light E, hereinafter. As shown in FIG. 5, the upper display 10A sticks out more frontward in comparison with the surfaces of the sticker pasting surfaces 46. The light emitting devices 30 are arranged on side surfaces of the upper display 10A. Accordingly, the pair of light emitting devices 30 are positioned more frontward than the sticker pasting surfaces 46 when the gaming machine 1 is viewed from front. That is, a light axis A running from a light emitting device 30 to a reflector 48 is also positioned more frontward than a sticker pasting surface 46. As a result, irradiation light E from a light emitting device 30 lights up a sticker pasting surface 46 arranged outside of the upper display 10A. Therefore, a sticker 60 pasted onto a sticker pasting surface 46 is lit up by irradiation light E from a light emitting device 30. Irradiation light E from a light emitting device 30 on the upper display 10A goes toward a reflector 48 while lighting up a sticker pasting surface 46.

Figure 6:
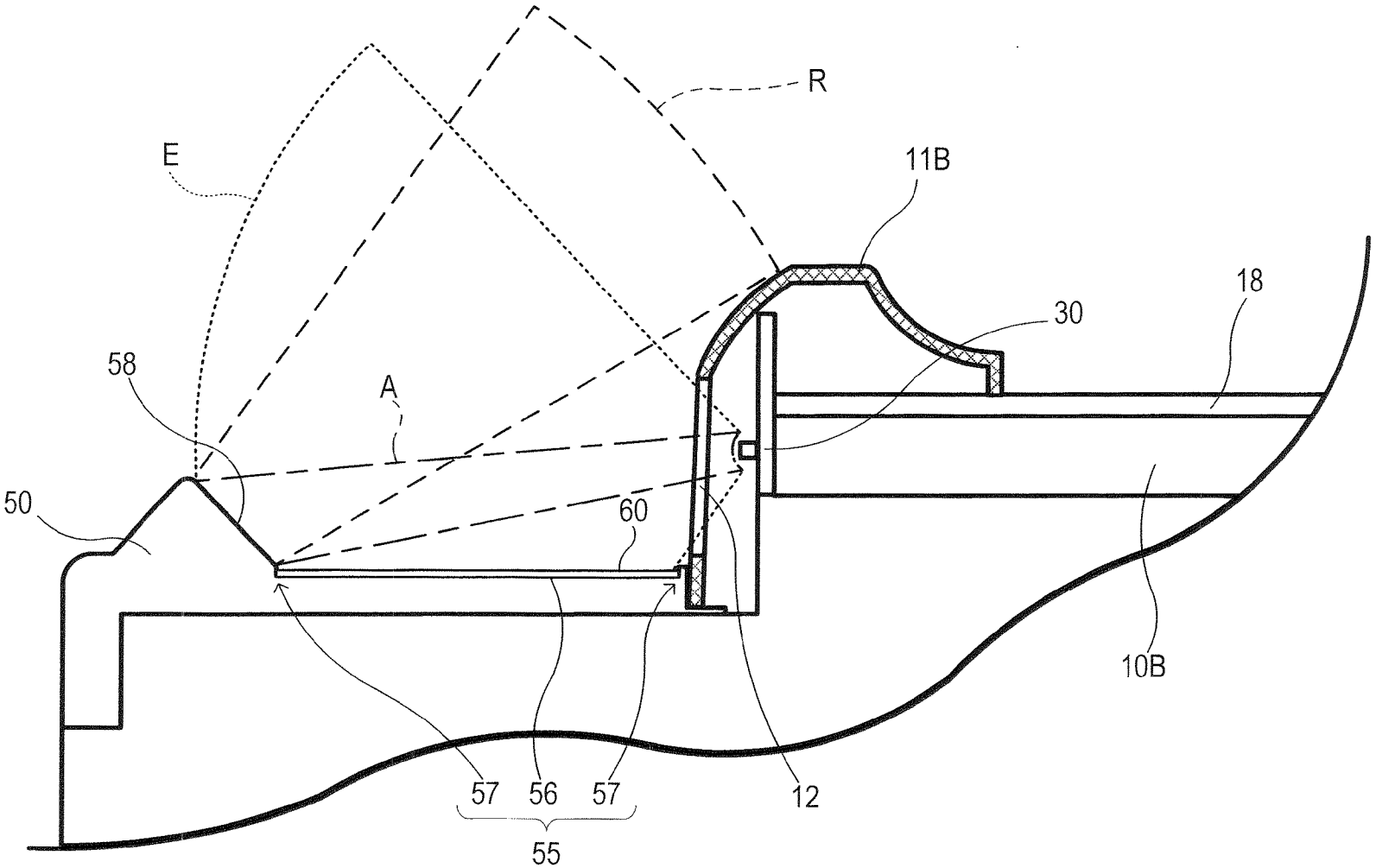
FIG. 6 is a view for illustrating positional relation of a light emitting device, a sticker pasting portion and a reflector according to the first embodiment of the present invention.

Similarly with the side surface portions of the upper display 10A, on the side surface portions of the main display 10B, the pair of light emitting devices 30 are covered with the main display cover member 11B which is made of a light transmissive material. The main display cover member 11B has a pair of light transmissive portions 12 at its side portions facing the respective light emitting devices 30. The light transmissive portions 12 are made of a light transmissive material (e.g., translucent acrylic or the like). Accordingly, light of a light emitting device 30 is not blocked by the main display cover member 11B. A light emitting device 30 emits light mainly toward a side-end direction of the slot machine 1. As shown in FIG. 5 and FIG. 6, the main display 10B sticks out more frontward in comparison with the surfaces of the sticker pasting surfaces 56. The light emitting devices 30 are arranged on side surfaces of the main display 10B. Accordingly, the pair of light emitting devices 30 are positioned more frontward than the sticker pasting surfaces 56 when the gaming machine 1 is viewed from front. That is, a light axis A running from a light emitting device 30 to a reflector 58 is also positioned more frontward than a sticker pasting surface 56 (refer to FIG. 6). As a result, irradiation light E from a light emitting device 30 lights up a sticker pasting surface 56 arranged outside of the main display 10B (FIG. 6). Therefore, a sticker 60 pasted onto a sticker pasting surface 56 is lit up by irradiation light E from a light emitting device 30. Irradiation light E from a light emitting device 30 on the main display 10B goes toward a reflector 58 while lighting up a sticker pasting surface 56.

The slot machine 1 makes stickers 60 pasted onto sticker pasting surfaces (namely, sticker pasting surfaces 46 and sticker pasting surfaces 56) stand out by using irradiation light E from the light emitting devices 30 (refer to FIG. 6). As a result, the slot machine 1 gives players such an impression that design of the slot machine 1 harmonizes with an atmosphere of a game arcade where the slot machine 1 is installed.

As shown in FIG. 1 through FIG. 6, the upper front cover 40 has the pair of reflectors 48 at positions more to the outside than positions of the pair of sticker pasting surfaces 46. The reflectors 48 slant by predetermined angle with respect to the respective sticker pasting surfaces 46. More specifically, a reflector 48 and a sticker pasting surface 46 make an obtuse angle. Further, surface treatment (e.g., mirror-like finishing) is applied to the surfaces of the reflectors 48 so as to reflect light. Accordingly, a reflector 48 may reflect irradiation light E of a light emitting device 30 frontward with respect to the upper display 10A. In the first embodiment, irradiation light E reflected by a reflector is termed reflected light R.

Further, the front cover member 50 has the pair of reflectors 58 at positions more to the outside of the pair of sticker pasting surfaces 56. The reflectors 58 slant by predetermined angle with respect to the respective sticker pasting surface 56. More specifically, a reflector 58 and a sticker pasting surface 56 make an obtuse angle. Further, surface treatment (e.g., mirror-like finishing) is applied to the surfaces of the reflector 58 so as to reflect light. Accordingly, a reflector 58 may reflect irradiation light E of a light emitting device 30 frontward with respect to the main display 10B.

As earlier described, a player is seated in front of the slot machine 1 for playing the game. That is, the player engaged in the game is positioned in front of the upper display 10A and the main display 10B. Plural beams of reflected light R by the respective reflectors 48 go frontward with respect to the upper display 10A. Similarly, plural beams of reflected light R by the respective reflectors 58 go frontward with respect to the main display 10B. Accordingly, those plural beams of reflected light R by the reflectors eventually reach the player seated in front of the slot machine 1. This makes the player engaged in the game aware of the reflectors 48 and the reflectors 58 that create the beams of reflected light R. The first sticker pasting portions 45 adjoin the respective reflectors 48. The second sticker pasting portions 55 adjoin the respective reflectors 58. Therefore, the player catches sight of the stickers 60 pasted onto the first sticker pasting portions 45 and the second sticker pasting portions 55. As a result, the slot machine 1 gives the player an impression that design of the slot machine 1 harmonizes with an atmosphere of a game arcade where the slot machine 1 is installed.

As earlier described, the slot machine 1 according to the first embodiment has the upper front cover member 40 and the front cover member 50 on the front face of the cabinet 2. The upper display 10A is arranged at the center part of the upper front cover member 40. Further, the main display 10B is arranged at the center part of the front cover member 50. The upper cover member 40 has the first sticker pasting portions 45 at the left side and the right side of the upper display 10A. The front cover member 50 has the second sticker pasting portions 55 at the left side and the right side of the main display 10B.

Each of the first sticker pasting portions 45 consists of a sticker pasting surface 46 and a raised portion. A sticker 60 is pasted onto the sticker pasting surface 46. The shape of the sticker 60 is the same as that of the sticker pasting surface 46. The raised portion is raised by predetermined raised height D along periphery of the sticker pasting surface 46. The raised height D of the raised portion 47 is made higher than sticker thickness S of the sticker 60.

Similarly to the first sticker pasting portions 45, each of the second sticker pasting portions 55 consists of a sticker pasting surface 56 and a raised portion 57. A sticker 60 is pasted onto the sticker pasting surface 56. The shape of the sticker 60 is the same as that of the sticker pasting surface 56. The raised portion 57 is raised by predetermined raised height D along periphery of the sticker pasting surface 46. The raised height D of the raised portion 57 is made higher than sticker thickness S of the sticker 60.

Accordingly, in the slot machine 1 according to the first embodiment, it is possible to change stickers 60 to be pasted onto the sticker pasting surfaces 46 and the sticker pasting surfaces 56. That is, the slot machine 1 is capable of harmonizing with an atmosphere of a game arcade by using stickers 60 with decorative images that harmonize with the atmosphere of the game arcade. Furthermore, using stickers 60 is cheaper than using decorative panels and the like. Accordingly, the slot machine 1 is capable of harmonizing with an atmosphere of a game arcade at lower cost.

As earlier described, a raised portion is raised along periphery of a sticker pasting surface for each of the first sticker pasting portions 45 and the second sticker pasting portions 55. A shape of a sticker 60 is the same as that of a corresponding sticker pasting surface. Accordingly, when a sticker 60 is pasted onto a sticker pasting surface, edges of the sticker 60 and corresponding side surfaces of the raised portion get contact with each other. That is, a third person can hardly catch and scratch an edge of a sticker 60 with his/her nail or the like. Accordingly, the slot machine 1 prevents a third person from peeling off the stickers 60.

When trying to peel off a sticker 60, a third person generally applies force from an edge of the sticker 60 to the inside thereof with his/her nail or the like. A raised portion is raised from the level of a sticker pasting surface by predetermined height (i.e., raised height D) which is higher than sticker thickness S. Further, edges of a sticker 60 and corresponding side surfaces of a raised portion get contact with each other. Therefore, even if a nail or the like is made to move inwardly from a raised portion, the nail reaches the surface of the sticker 60 without catching an edge of the sticker 60. That is, the slot machine 1 makes it more difficult for a nail or the like to catch an edge of the sticker 60. As a result, the slot machine 1 makes it possible to prevent a third person from peeling off the sticker 60 more strictly.

As described earlier, the pair of first sticker pasting portions 45 are arranged so as to adjoin the left side and the right side of the upper display 10A. Further, the pair of second sticker pasting portions 55 adjoin the left side and the right side of the main display 10B. The upper display 10A and the main display 10B independently display information necessary for the game of the slot machine 1. Accordingly, stickers 60 pasted onto the first sticker pasting portions 45 and the second sticker pasting portions 55 naturally come into sight of the player. As a result, the slot machine 1 impresses the contents depicted on the stickers 60 (the design harmonizing with the atmosphere of the game arcade) on the player.

Further, the upper display 10A sticks out more frontward than the sticker pasting surfaces 46 of the pair of first sticker pasting portions 45. Similarly, the main display 10B sticks out more frontward than the sticker pasting surfaces 56 of the pair of second sticker pasting portions 56. Further, the light emitting devices 30 are arranged at side surfaces of the upper display 10A and those of the main display 10B as pair for each of them. The light emitting devices 30 emit beams of irradiation light E mainly toward side-end directions of the slot machine 1 (refer to FIG. 6). As shown in FIG. 6, a light axis A from a light emitting device 30 is positioned more frontward than a sticker pasting surface. Accordingly, a sticker 60 pasted onto a sticker pasting surface is irradiated by irradiation light E from the light emitting device 30. Thereby, the slot machine 1 makes the stickers 60 stand out much more. As a result, the slot machine 1 impresses the contents depicted on the stickers 60 (the design harmonizing with the atmosphere of the game arcade) on the player.

Further, the upper front cover member 40 has the reflectors 48 on the outside of the first sticker pasting portions 45. The front cover member 50 has the reflectors 58 on the outside of the second sticker pasting portions 55. As described earlier, irradiation light E from a light emitting device goes for a reflector. In this case, a light axis A from the light emitting device 30 to the reflector is positioned more frontward than the sticker pasting surface. Each reflector reflects irradiation light E from a light emitting device 30 in a direction ahead of the upper display 10A and the main display 10B (refer to FIG. 6). The player engaged in the game is positioned in front of the upper display 10A and the main display 10B. Accordingly, reflected light R by a reflector 48 reaches the player. Thereby, the player is aware of the vicinity of the reflector. That is, the player is aware of a sticker 60 pasted onto a sticker pasting surface. As a result, the slot machine 1 gives the player a strong impression to contents depicted on the sticker (i.e., sticker design that harmonizes with an atmosphere of a game arcade.

The present invention is not limited to the above-described embodiments, and it is obvious that various improvements and modifications can be made thereto without departing from the spirit of the present invention. For instance, the gaming machine according to the present invention is not limited to a slot machine but is applicable to various types of gaming machines (e.g., card gaming machine and the like).

For instance, in the gaming machine according to the present invention, configuration of the sticker pasting surface 46 and that of the sticker pasting surface 56 are not limited to the foregoing embodiment. For instance, the sticker pasting surfaces may be subject to specific surface treatment. More specifically, it is feasible to form plural tiny surface projections on the respective sticker pasting surfaces. In this case, the gaming machine according to the present invention may reduce area of contact between a sticker's adhesive layer and a sticker pasting surface. Therefore, an administrator of the gaming machine can easily peel off stickers pasted onto sticker pasting surfaces. Accordingly, the gaming machine is capable of harmonizing with an atmosphere of a game arcade more easily.

Further, regarding the sticker pasting surface of this case, region subject to have tiny surface projections may be restricted. That is, tiny surface projections may be applied to region other than periphery of the sticker pasting surface (i.e., other than the vicinity of the raised portion). With such configuration, the gaming machine can prevent a third person from peeling off a sticker while lessening administrator's effort to change stickers.

As earlier described, it is preferable that stickers to be pasted onto sticker pasting surfaces have decorative images that harmonize with an atmosphere of a game arcade where the gaming machine according to the present invention is installed. However, image contents of the stickers are not limited to the above described ones. For instance, stickers may have illustration representing game contents (game concept) of the game in the gaming machine.

Second Embodiment

Next, a gaming machine according to the second embodiment will be described in detail while referring to the drawings as embodied in a slot machine. Here, the slot machine according to the following embodiment is a slanted-type slot machine at which the player plays while sitting on a seat placed in front of the slot machine.

The slot machine 1001 according to the present invention has two displays (an upper display 1010A and a main display 1010B) arranged one above the other at a position from a middle to an upper level of a cabinet 1002. The upper display 1010A and the main display 1010B display information (symbols, effect images, credit information, help screen or the like) with respect to the game to be executed in that slot machine 1001 on their respective display surfaces.

Figure 7:
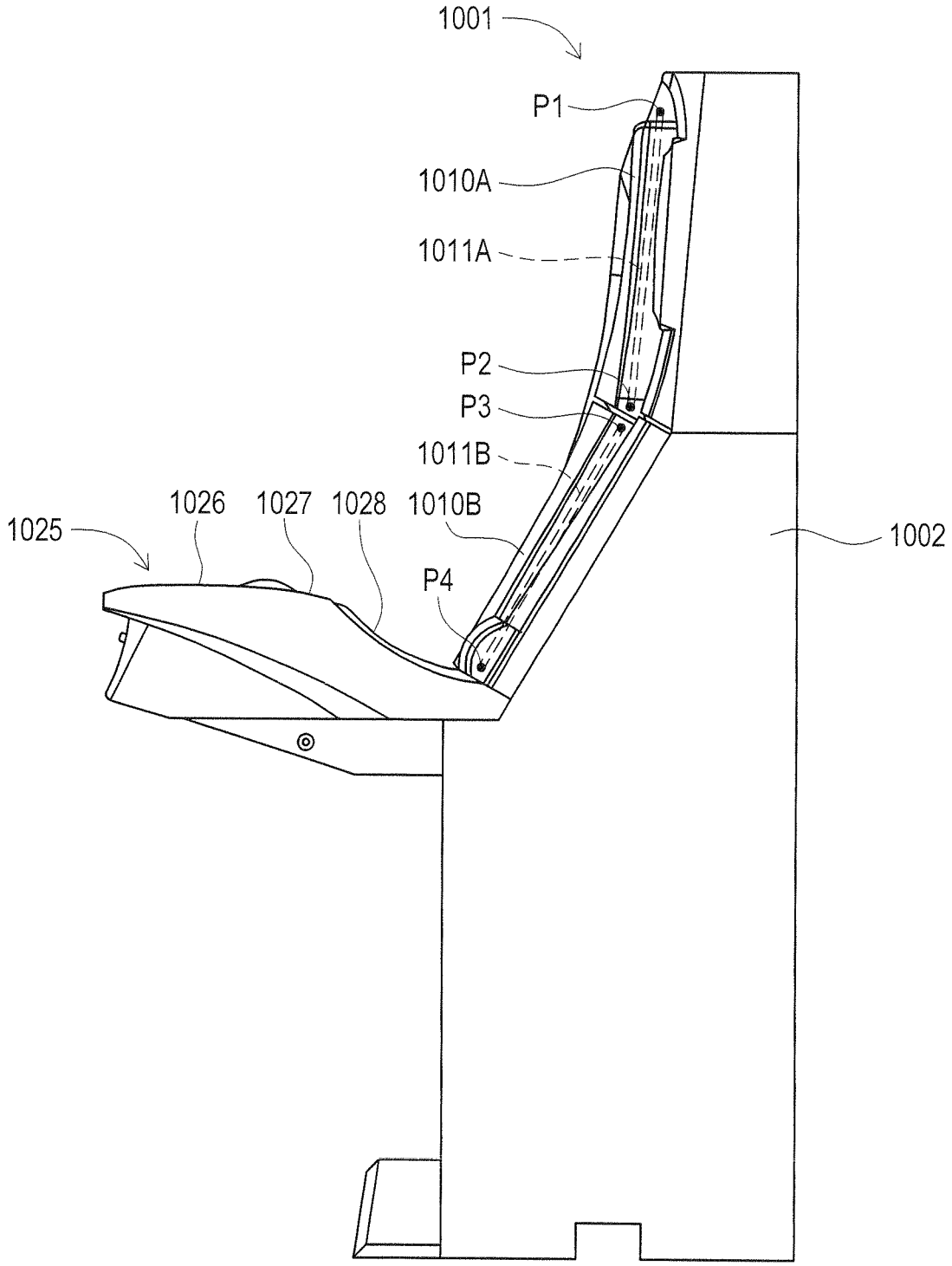
FIG. 7 is a side view showing an outer appearance of a slot machine according to the second embodiment of the present invention.

As shown in FIG. 7, regarding the upper display 1010A, a lower end P2 of the display surface 1011A is positioned more frontward (leftward side in FIG. 7) than an upper end P1 thereof with reference to the slot machine 1001. In the case of the main display 1010B as well, a lower end P4 of the display surface 1011B is positioned more frontward (leftward side in FIG. 7) than an upper end P3 thereof with reference to the slot machine 1001. Here, an inclination angle of the display surface 1011A with respect to a vertical direction is smaller than an inclination angle of the display surface 1011B with respect to a vertical direction.

Figure 8:
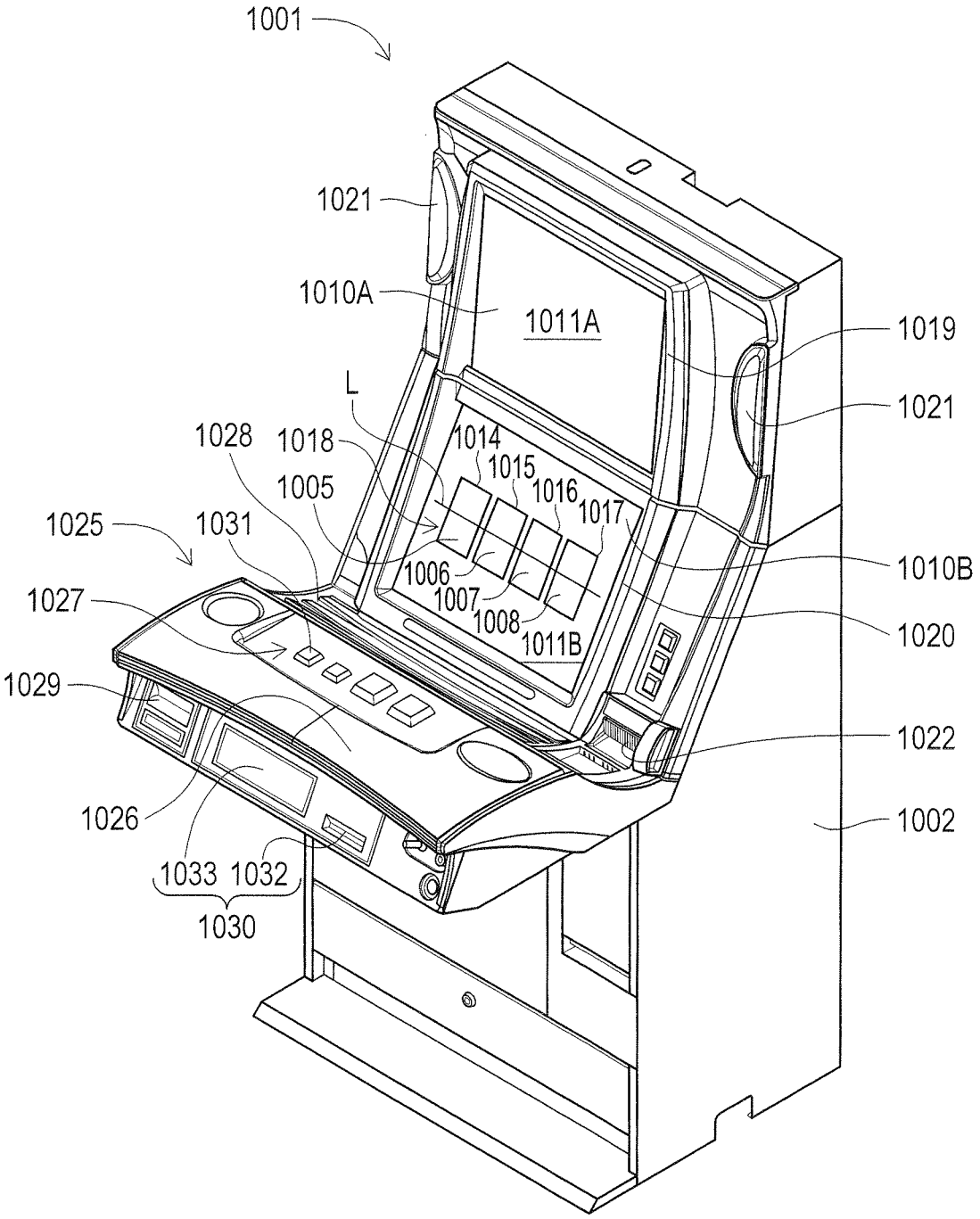
FIG. 8 is a perspective view showing an outer appearance of the slot machine according to the second embodiment of the present invention.
Figure 9:
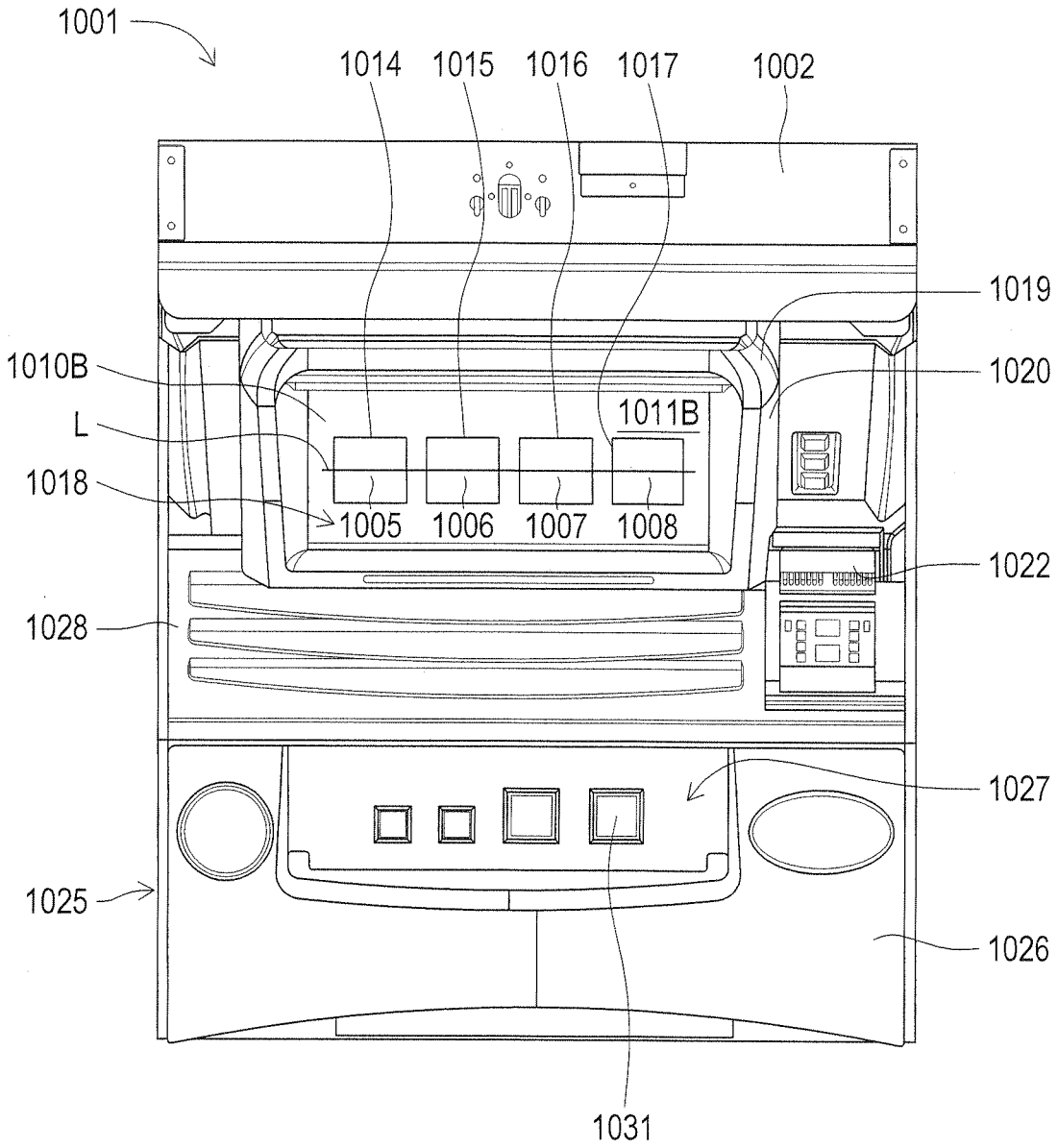
FIG. 9 is a top view showing an outer appearance of the slot machine according to the second embodiment of the present invention.

Next, the slot machine 1001 according to the second embodiment will be described in detail while referring to the drawings. FIG. 8 is a perspective view showing an outer appearance of the slot machine 1001 according to the second embodiment. FIG. 9 is a top view showing an outer appearance of the slot machine 1001 according to the second embodiment.

As shown in FIG. 8 and FIG. 9, the slot machine 1001 has a cabinet 1002. The cabinet 1002 houses electrical and mechanical components for executing a predetermined game aspect in the slot machine 1001. Four reels (specifically, a first reel 1005, a second reel 1006, a third reel 1007 and a fourth reel 1008) are provided inside the cabinet 1002 in a freely rotating fashion. The first reel 1005 through the fourth reel 1008 each have a symbol string drawn on an outer peripheral surface thereof. Each symbol string is made up of a predetermined number of symbols. Also, each symbol string includes a plurality of types of symbols.

The cabinet 1002 has an upper display 1010A and a main display 1010B provided at a front face thereof. The upper display 1010A is arranged at a front upper portion of the cabinet 1002. The upper display 1010A is made up of a heretofore known liquid crystal panel. The upper display 1010A displays information with respect to the game to be played on the display surface 1011A. The display contents to be displayed on the upper display 1010A include effect images, introduction of the game contents, game rule explanations and the like.

The main display 1010B is arranged at a front middle portion of the cabinet 1002. The main display 1010B is made up of a heretofore known transparent liquid crystal panel or the like. The main display 1010B displays information with respect to the game on the display surface 1011B. The display contents to be displayed on the main display 1010B include effect images, contents of the acquired prize, bet amount and the credit amount possessed by the player and the like. Specifically, the player progresses the game in the slot machine 1001 based on the display of the upper display 1010A and the main display 1010B.

The main display 1010B has a first display window 1014, a second display window 1015, a third display window 1016 and a fourth display window 1017. As described earlier, the first reel 1005 through the fourth reel 1008 are arranged inside the cabinet 1002. The main display 1010B is positioned in front of the first reel 1005 through the fourth reel 1008. In the main display 1010B, the first display window 1014 through the fourth display window 1017 are formed at portions corresponding to the first reel 1005 through the fourth reel 1008. For instance, the first display window 1014 is formed at a position corresponding to the front of the first reel 1005 of the main display 1010B. In the slot machine 1001, the inner side of the first display window 1014 through the fourth display window 1017 can be changed to a transparent state. This enables players to view a back of the main display 1010B through the first display window 1014 through the fourth display window 1017. Specifically, the players can see the symbols drawn on the first reel 1005 through the fourth reel 1008 through the first display window 1014 through the fourth display window 1017.

The main display 1010B displays one pay line L. The pay line L crosses the center of the first display window 1014 through the fourth display window 1017 in a horizontal fashion. The pay line L defines a symbol combination constituting the game results. Accordingly, if the symbol combination which has been repositioned on the pay line L is a predetermined winning combination, the slot machine 1001 awards a payout in accordance with this combination and the credit amount (bet amount) thus bet.

In the present invention, the number of reels is not limited to four reels. Specifically, the number of reels in the slot machine 1001 can be changed to a different number.

Further, a touch panel 1018 is provided at a front face of the main display 1010B. Accordingly, the player can operate the touch panel 1018 to input various types of commands. For instance, the players can select a desired selection from a plurality of selections which are displayed on the main display 1010B, by depressing the touch panel 1018 with a finger.

A luminescent device which is not illustrated is arranged inside an upper frame 1019 formed at a peripheral edge of the upper display 1010A. A similar luminescent device which is not illustrated is arranged inside a lower frame 1020 formed at a peripheral edge of the main display 1010B. These luminescent devices light up in a predetermined lighting fashion in case predetermined conditions (for instance, at the time of winning) are satisfied.

Speakers 1021 are provided at a front face of the cabinet 1002. Speakers 1021 are provided as a pair at a right side and left side of the upper frame 1019. Speakers 1021 output sound in accordance with the progress of the game.

A bill slot 1022 is formed at a front face of the cabinet 1002. The bill slot 1022 is adapted to accept bills inside the cabinet 1002. At the slot machine 1001, the player can insert a predetermined ticket in the bill slot 1022. Such a ticket is outputted from the ticket printer 1029 as will be described later. This ticket includes information with respect to the amount of gaming values awarded to the player based on the game results. Specifically, the slot machine 1001 can identify the amount of gaming values which can be used in the game based on the gaming value amount information included in such a ticket.

In the slot machine 1001 according to the second embodiment, bills, tickets or electronic valuable information (credits) corresponding to these can be used as gaming values. The gaming values applicable to this invention are not limited to these. For instance, coins, medals, tokens, electronic money, tickets or the like can also be employed.

The slot machine 1001 has a frontward projecting portion 1025 which is projected from the lower end of the main display 1010B arranged in the cabinet 1002 to frontward (leftward in FIG. 7) of the slot machine 1001. The frontward projecting portion 1025 has an armrest 1026, a control panel 1027, a connecting surface 1028, a ticket printer 1029, a player information display device 1030 and a woofer (not shown).

The armrest 1026 is a human contact portion which comes in contact with a player's arm or elbow when the player operates the operation buttons arranged on the control panel 1027. The armrest 1026 is arranged at a periphery of the control panel 1027 on an upper surface of the frontward projecting portion 1025. A player who sits in front of the slot machine 1001 can thus play a game while resting his/her arm or elbow on the armrest 1026.

The control panel 1027 is made up of a plurality of operation buttons 1031. The plurality of operation buttons 1031 include a BET button, a COLLECT button, a START button, a CASHOUT button and the like. The control panel 1027 is used by the player to carry out operations in the game. The control panel 1027 represents a human contact portion which comes in contact with a player's hand when he/she operates the operation buttons arranged on the control panel 1027.

A connecting surface 1028 is a member which connects the cabinet-side end of the arm rest 1026 and the control panel 1027 with the lower end of the main display 1010B, covering the upper surface of the frontward projecting portion 1025. The connecting surface 1028 will be described in detail later while referring to the drawings.

The ticket printer 1029 prints information showing the amount of gaming values on a sheet of paper and then discharges the printed sheet. After the game has ended, the ticket printer 1029 prints the amount of gaming values that the player possesses on a sheet of paper and then discharges the printed sheet as a ticket.

The player information display device 1030 has a card reader 1032, an information display 1033 and a control device and the like which is not illustrated. The player information display device 1030 reads this player information from the player card which stores player information. Then, the player information display device 1030 displays the player information thus read out on the information display 1033. Thus, the player information display device 1030 notifies the corresponding player information (for instance, history of game results for this player) to the player.

The woofer is arranged inside the frontward projecting portion 1025, with the sound output direction facing downward. The woofer is a speaker specialized in low-pitched sound output.

Figure 10:
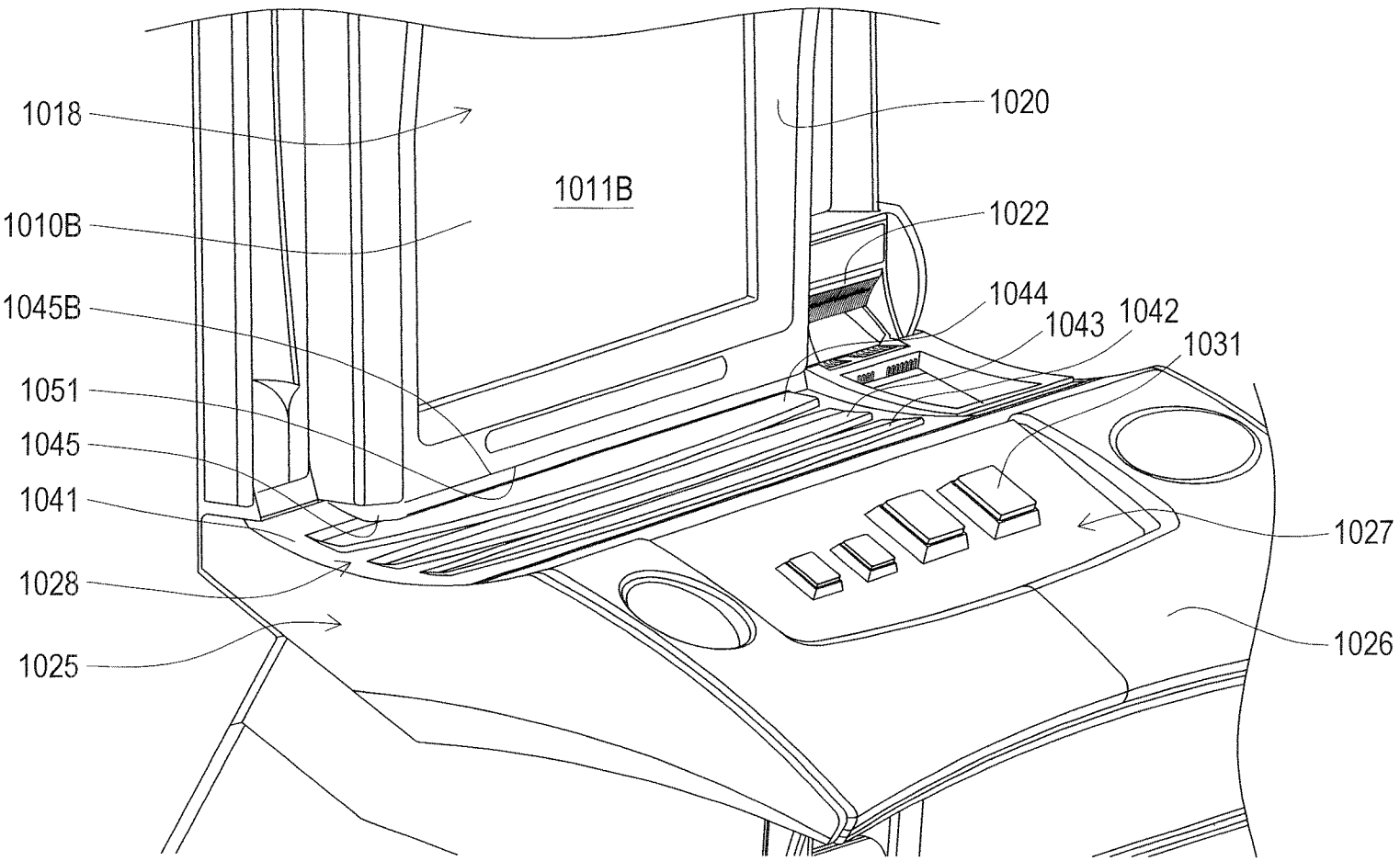
FIG. 10 is an enlarged perspective view showing a connecting surface of the slot machine and the vicinity thereof according to the second embodiment of the present invention.
Figure 11:
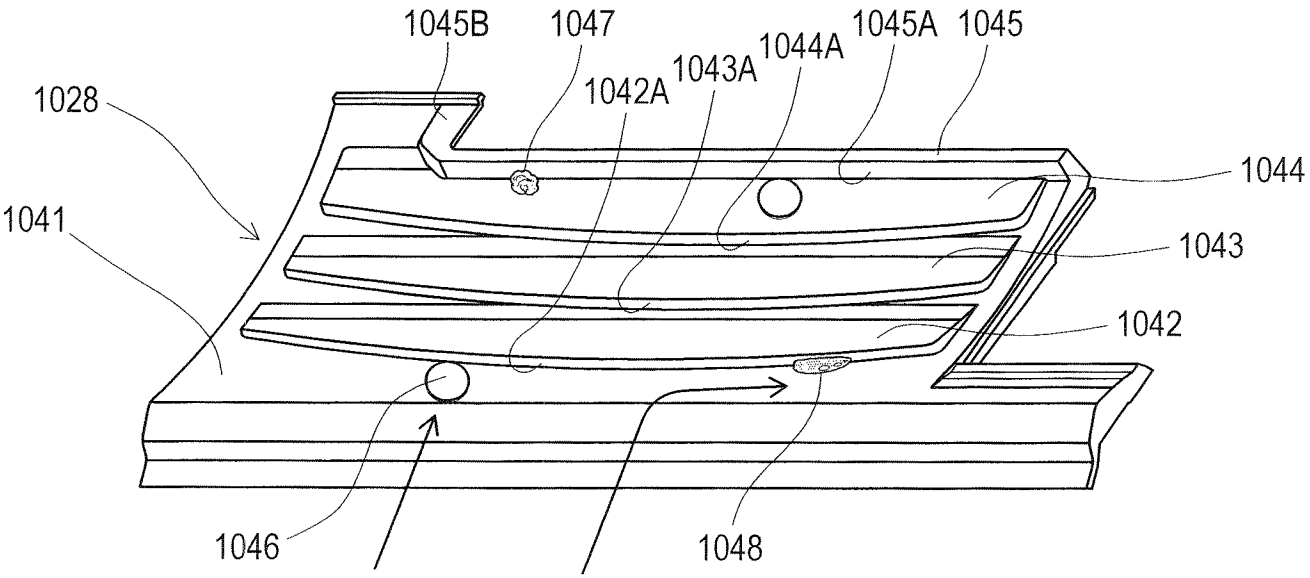
FIG. 11 is a perspective view showing the connecting surface in the slot machine according to the second embodiment of the present invention.
Figure 12:
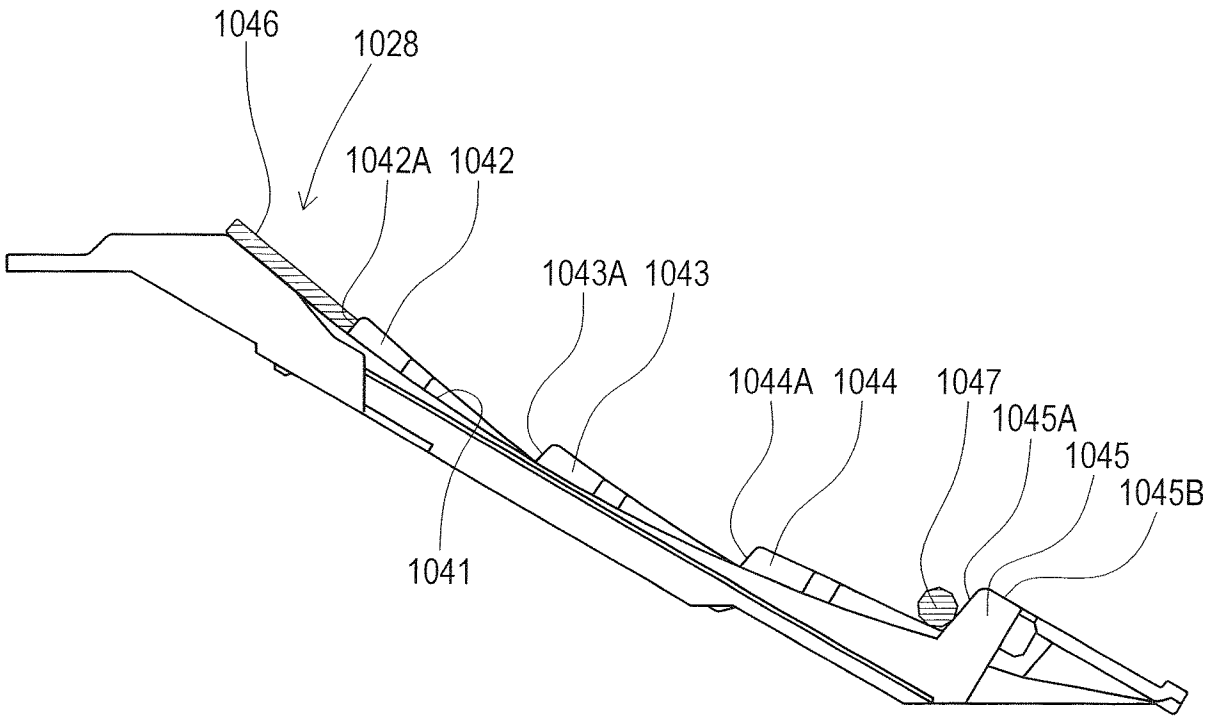
FIG. 12 is a side view showing the connecting surface in the slot machine according to the second embodiment of the present invention.

Next, the connecting surface 1028 provided in the frontward projecting portion 1025 will be described in detail based on FIG. 10 through FIG. 12. FIG. 10 is an enlarged perspective view showing the connecting surface of the slot machine and the vicinity thereof according to the second embodiment. FIG. 11 is a perspective view showing the connecting surface according to the second embodiment. FIG. 12 is a side view showing the connecting surface according to the second embodiment.

The connecting surface 1028 is a member which connects the cabinet-side end of the arm rest 1026 and the control panel 1027 with the lower end of the main display 1010B.

As shown in FIG. 11, the connecting surface 1028 is made up of a plate-like member having a rectangular shape. The connecting surface 1028 is arranged between the armrest 1026 and the control panel 1027 in a united form and the lower end of the main display 1010B, with respect to the upper surface of the frontward projecting portion 1025. As shown in FIG. 12, the connecting surface 1028 provided in the frontward projecting portion 1025 is slanted downward in a depth direction (rightward direction in FIG. 12) of the slot machine 1001. Specifically, the lower end of the display surface 1011B in the main display 1010B is arranged downward below the armrest 1026 and the control panel 1027 which represent human contact portions.

As shown in FIG. 11 and FIG. 12, the connecting surface 1028 is curved down so that a central portion thereof in a depth direction of the slot machine 1001 is positioned lower than the edge portions thereof in a depth direction. The upper surface 1041 of the curved connecting surface 1028 has three raised portions 1042 through 1044 and a protruding wall 1045 formed thereon.

Here, the raised portions 1042 through 1044 are each formed in a curved shape parallel with respect to a width direction of the slot machine 1002. The raised portions 1042 through 1044 are respectively arranged next to each other in a depth direction of the slot machine 1001. The arc-like portions of the raised portions 1042 through 1044 face the armrest 1026 and the control panel 1027. As shown in FIG. 12, the arc-like portions of the raised portions 1042 through 1044 form steps 1042A through 1044A on the upper surface 1041 of the connecting surface 1028.

Here, the connecting surface 1028 as described above is slanted downward with respect to a depth direction of the slot machine 1001. Accordingly, when a coin 1046 or dust 1047 placed on the armrest 1026 or control panel 1027 falls from the armrest 1026 or the control panel 1027 in a depth direction of the slot machine 1001, the coin 1046 or dust 1047 will slip on the upper surface 1041 of the connecting surface 1028, moving towards the main display 1010B. However, as steps 1042A through 1044A are formed on the upper surface 1041 of the connecting surface 1028, the coin 1046 or dust 1047 will be stopped from falling by any of the steps 1042A through 1044A, as shown in FIG. 11 and FIG. 12. This enables a player or staff to easily collect the coin 1046 or the dust 1047 dropped from the armrest 1026 and the control panel 1027.

Alternatively, if liquid 1048 such as drinking water or the like placed on the armrest 1026 or the control panel 1027 falls from the armrest 1026 or the control panel 1027 in a depth direction of the slot machine 1001, the liquid which has fallen as shown in FIG. 11 will be temporarily stopped at the steps 1042A through 1044A. Then, the liquid will flow to the side of the slot machine 1001 along the arc-like shape of the steps 1042A through 1044A. Thus, the liquid 1048 can be prevented from entering inside the cabinet 1002.

Alternatively, the protruding wall 1045 is a wall-shaped member formed so as to protrude upward from the upper surface 1041 of the connecting surface 1028. The protruding wall 1045 is formed along the edge portion facing the lower end of the main display 1010B. As shown in FIG. 10, the lower end surface 1051 of the main display 1010B is provided in the cabinet 1002 while being in contact with the upper surface 1045B of the protruding wall 1045. Specifically, a clearance which is formed between the main display 1010E and the frontward projecting portion 1025 is covered by the protruding wall 1045.

Accordingly, even if a coin 1046, dust 1047 or liquid 1048 which has fallen from the armrest 1026 or the control panel 1027 passes over the steps 1042A through 1044A of the connecting surface 1028 and moves in the direction of the main display 1010B, the coin 1046, the dust 1047 or the liquid 1048 will be stopped from moving while being in contact with the side surface 1045A of the protruding wall 1045 before reaching the protruding wall 1045, as shown in FIG. 11 and FIG. 12. Thus, a coin 1046, dust 1047 or liquid 1048 will not enter in the clearance formed between the main display 1010B and the frontward projecting portion 1025.

Figure 13:
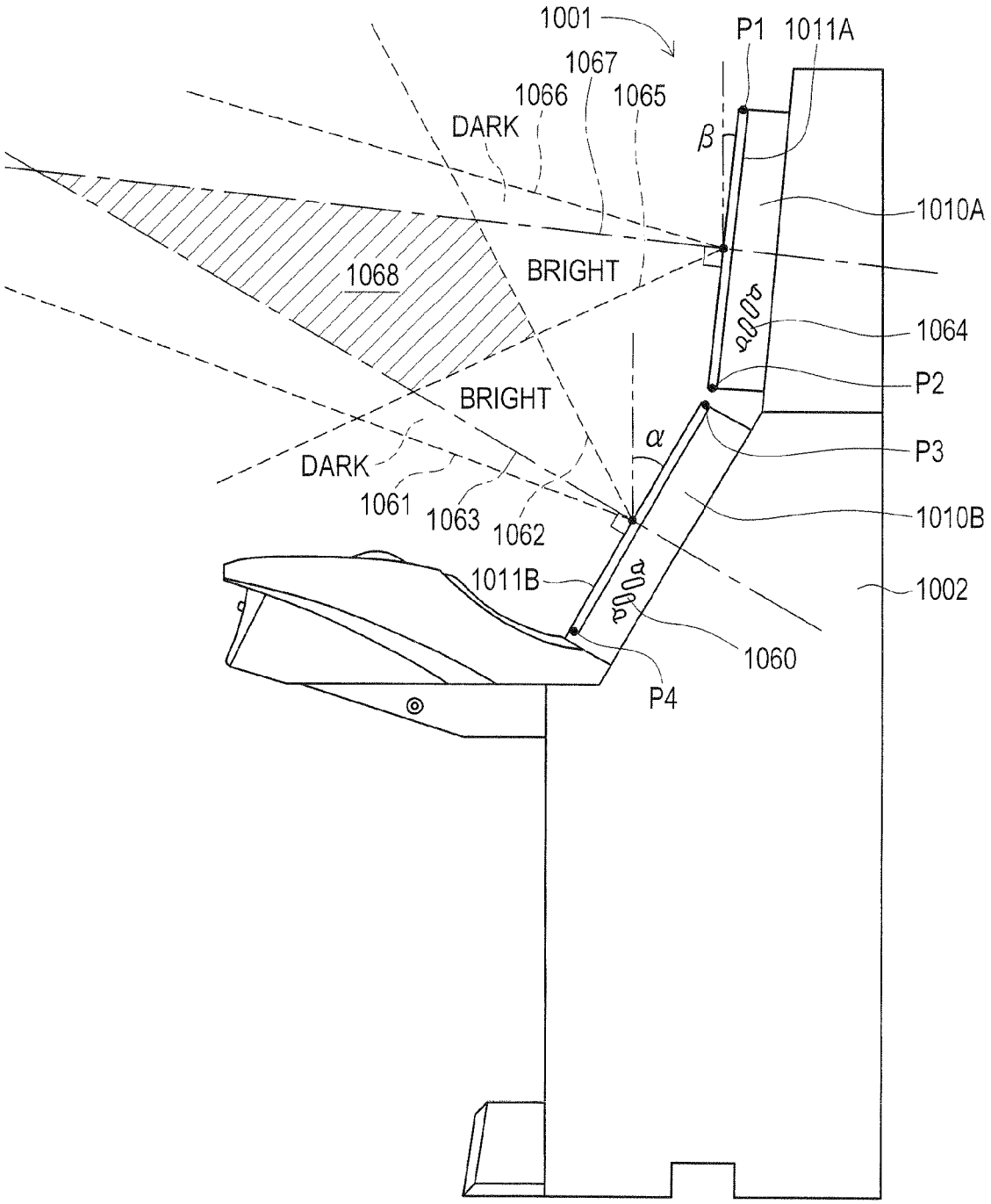
FIG. 13 is a view showing an arrangement pattern for displays in the slot machine according to the second embodiment of the present invention.

An arrangement pattern of the upper display 1010A and the main display 1010B in the slot machine 1001 according to the second embodiment will be described in detail using FIG. 13. FIG. 13 is a side view of a slot machine according to the second embodiment. FIG. 13 shows the cabinet 1002 with the upper frame 1019 and the lower frame 1020 removed therefrom.

The main display 1010B is arranged in the cabinet 1002 in a slanted fashion so that the lower end P2 of the display surface 1011B is positioned further frontward (leftward in FIG. 13) than the upper end P1 thereof with reference to the slot machine 1001, as shown in FIG. 13. Specifically, the display surface 1011B is arranged at a position corresponding to an a inclination angle with respect to a vertical direction.

Alternatively, the upper display 1010A is arranged in the cabinet 1002 in a slanted fashion so that the lower end P4 of the display surface 1011A is positioned further frontward (leftward in FIG. 13) than the upper end P3 thereof with reference to the slot machine. More specifically, the display surface 1011A is arranged at a position corresponding to a $\beta$ inclination angle with respect to a vertical direction. Angle $\beta$ is smaller than angle $\alpha$. Specifically, the display surface 1011B of the main display 1010E is arranged at a larger inclination angle with respect to the vertical direction than the display surface 1011A of the upper display 1010A.

The upper display 1010A and the main display 1010B are arranged in the cabinet 1002 in a fashion taking into consideration the slanted direction of the liquid crystal molecules 1060 which become slanted when voltage is applied thereto.

For instance, the main display 1010B is placed in the cabinet 1002 in a fashion that a slanted direction of the liquid crystal molecules 1060 which will become slanted when voltage is applied thereto is arranged so that lower ends of the liquid crystal molecules 1060 are positioned more frontward than the upper ends thereof.

Here, if the liquid crystal molecules are arranged on a slant with respect to the display surface, generally, the screen of the liquid crystal display appears bright when viewed on a slant from a position forming a right angle with the slanted direction of the liquid crystal molecules. Alternatively, it is widely known that the screen of the liquid crystal display appears dark when viewed on a slant from a direction which is parallel with the slanted direction of the liquid crystal molecules.

Accordingly, if the main display 1010B is arranged in the cabinet 1002 with the liquid crystal molecules 1060 being in a slanted direction when voltage is applied thereto so that the lower ends of the liquid crystal molecules 1060 are positioned more frontward than the upper ends thereof, the display surface of the main display 1010B appears bright when viewed from an upward position on a slant, as shown in FIG. 13. Alternatively, the display surface of the main display 1010B appears dark when viewed from a downward position on a slant. Specifically, when a viewing angle of the main display 1010B corresponds to the angle between the line 1061 and line 1062, the range from the line 1061 to a perpendicular line 1063 of the display surface 1011B is equal to the viewing angle range where the images displayed on the display surface 1011B appear dark. Also, the range from the line 1062 to the perpendicular line 1063 of the display surface 1011B corresponds to the viewing angle range where the images displayed on the display surface 1011B appear bright.

Alternatively, the upper display 1010A is arranged in the cabinet 1002 with the liquid crystal molecules 1064 being slanted when voltage is applied thereto so that upper ends of the liquid crystal molecules 1064 are positioned more frontward than lower ends thereof.

Accordingly, the display surface of the upper display 1010A appears bright when viewed from a downward position on a slant, as shown in FIG. 13. Alternatively, the display surface of the upper display 1010A appears dark when viewed from an upward position on a slant. Specifically, when a viewing angle of the upper display 1010A corresponds to the angle between the line 1065 and line 1066, the range from the line 1065 to a perpendicular line 1067 of the display surface 1011A corresponds to the viewing angle range where the images displayed on the display surface 1011A appear bright. Also, the range from the line 1066 to the perpendicular line 1067 of the display surface 1011A corresponds to the viewing angle range where the images displayed on the display surface 1011A appear dark.

Thus, as seen in FIG. 13, in the slot machine 1001 according to the second embodiment, the viewing angle range from where the images displayed on the upper display 1010A appear bright and the viewing angle range from where images displayed on the main display 1010B appear bright overlap each other. As a result, an area 1068 is formed wherein both displays appear bright. This area 1068 is formed between the upper display 1010A and the main display 1010B, in the vicinity of an upper portion of the armrest 1026. The position of this area 1068 coincides with the position of the player's head. Accordingly, both display screens will appear bright to the player.

Figure 14:
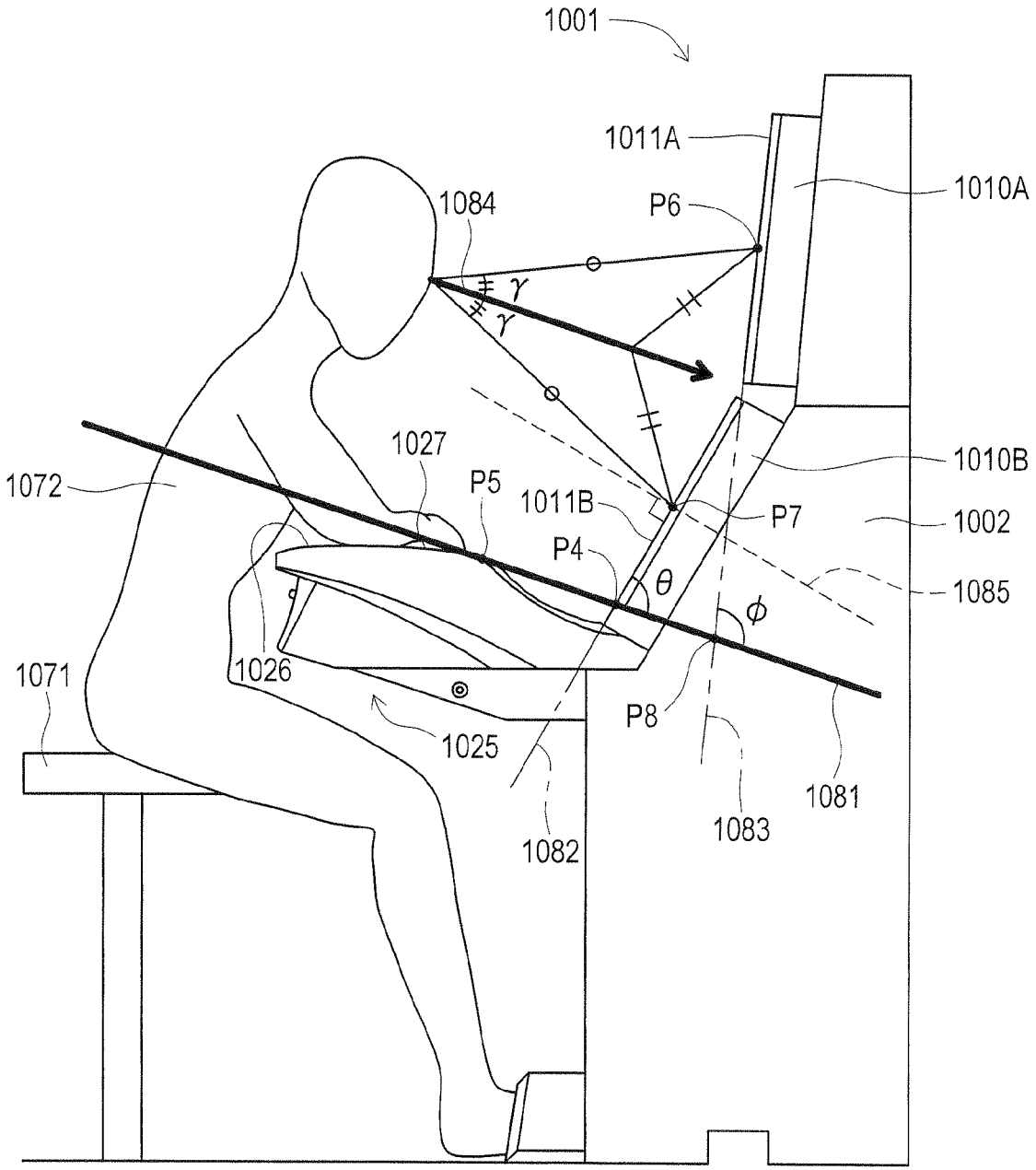
FIG. 14 is a view showing a positioning relationship between human contact portions and displays in a slot machine according to the second embodiment of the present invention.

Next, the arrangement pattern of the upper display 1010A and the main display 1010B in the slot machine 1001 according to the second embodiment will be described using their relative positioning relationship with the human contact portions (armrest 1026 or control panel 1027). FIG. 14 is a side view showing a slot machine and a player according to the second embodiment. FIG. 14 shows the cabinet 1002 with the upper frame 1019 and the lower frame 1020 removed therefrom.

As shown in FIG. 14, when a player 1072 sits on a seat 1071 to play a game, he/she will rest his/her arm or hand on the armrest 1026 or the control panel 1027 when executing the game. Specifically, as shown in the example in FIG. 14, the armrest 1026 and the control panel 1027 represent human contact portions which will come in contact with a part of the player's body.

In the following description, a first straight line 1081 defines a line which connects an end portion P5 on the cabinet-side of the human contact portions (armrest 1026 and control panel 1027) with the lower end P4 of the display surface 1011B of the main display 1010B, on a vertical section which is perpendicular with respect to a width direction of the slot machine 1001. On the same vertical section, a second straight line 1082 defines a line which runs along the display surface 1011B of the main display 1010B. Further, a third straight line 1083 defines a line which runs along the display surface 1011A of the upper display 1010A, on the same vertical section. Also, a fourth straight line 1084 defines a straight line corresponding to bisector of an angle between two line segments; namely, a segment connecting a position of the player's eyes and a central point PG in the display surface 1011A of the upper display 1010A and a segment connecting the position of the player's eyes and a central point P7 of the display surface 1011B of the main display 1010B, on the same vertical section. Furthermore, on the same vertical section, a fifth straight line 1085 defines a straight line which passes through the central point P7 of the display surface 1011B in the main display 1010B in a perpendicular direction with respect to the display surface 1011B.

In the slot machine 1001 according to the second embodiment, the lower end P4 of the display surface 1011B in the main display 1010B is positioned lower than the human contact portions (armrest 1026 and control panel 1027).

A half line backward in the cabinet of the first straight line 1081, originating from an intersection point P4 of the first straight line 1081 and the second straight line 1082 (a right-side half line originating from P4 in FIG. 14), and a half line on the main display 1010B side of the second straight line 1082, originating from the intersection point P4 (an upper-side half line originating from P4 in FIG. 14), form a θ angle. The θ angle is an acute angle)(θ<90°).

A half line backward in the cabinet of the first straight line 1081, originating from an intersection point P8 of the first straight line 1081 and the third straight line 1083 (a right-side half line originating from P8 in FIG. 14), and a half line on the upper display 1010A side of the third straight line 1083, originating from the intersection point P8 side (an upper-side half line originating from P8 in FIG. 14), form a ϕ angle. The ϕ angle is an obtuse angle (ϕ>90°).

The fourth straight line 1084 is parallel with the first straight line 1081. The fourth straight line 1084 passes through a position corresponding to the eyes of a player 1072 of an average height (for instance, 173 cm (for Asians)). In the slot machine 1001 according to the second embodiment, the human contact portions and the respective displays are arranged so that the first straight line 1081 will become parallel with the normal line of sight at the time the player 1072 of an average height plays a game in the slot machine 1001. Accordingly, the fourth straight line 1084 coincides with the line of sight of an average height player. Specifically, the display surface of the upper display 1010A and that of the main display 1010B each are arranged at a position (specifically, a target position centered around the normal line of sight of the player 1072) wherein the angles (in FIG. 14, angles γ) with respect to the normal line of sight of the player 1072 are the same. FIG. 14 shows a player 1072 of an average height playing a game.

The fifth straight line 1085 and the first straight line 1081 intersect further backward (right side in FIG. 14) in the cabinet 1002 than the lower end P4 of the display surface 1011B in the main display 1010B.

The slot machine 1001 according to the second embodiment as described above has an upper display 1010A and a main display 1010B. Here, the display surface 1011B of the main display 1010B is arranged at a larger inclination with respect to a vertical direction than the display surface 1011A of the upper display 1010A. Accordingly, the display surfaces of the plurality of displays which are arranged in the gaming machine can be arranged at an inclination angle enabling the player to view easily. Also, the height of the slot machine 1001 can be reduced, expanding a player's visual range.

The half line backward in the cabinet of the first straight line 1081, originating from the intersection point P4 of the first straight line 1081 and the second straight line 1082, and the half line on the main display 1010B side of the second straight line 1082, originating from the intersection point P4 form an acute angle. Further, the half line backward in the cabinet of the first straight line 1081, originating from the intersection point P8 of the first straight line 1081 and the third straight line 1083, and the half line on the upper display 10A side of the third straight line 1083, originating from the intersection point P8, form an obtuse angle. If it is assumed that the first straight line 1081 is parallel with the normal line of sight of the player, the display surface of the main display 1010B can be positioned downward with respect to the normal line of sight of the player and the display surface of the upper display 1010A can be positioned upward with respect to the normal line of sight of the player. As a result, a player can view the display surface of the upper display 1010A and the display surface of the main display 1010B with very little eye movement, reducing eye strain.

The fourth straight line 1084 is parallel with the first straight line 1081. Thus, if it is assumed that the first straight line 1081 is parallel with the normal line of sight of the player, the display surface of the upper display 1010A and that of the main display 1010B each can be arranged at a position (specifically, the target position centered around the normal line of sight of the player) where the angles with respect to the normal line of sight of the player are the same. Thus, the player can see the upper display 1010A and the main display 1010B with the same image quality. As the angle for the movement of the line of sight in the case the player looks at the upper display 1010A is equal to the angle for the movement of the line of sight in the case the player looks at the main display 1010B, the eye strain of a player who looks at a plurality of display surfaces can be reduced.

In the slot machine 1001 according to the second embodiment, the lower end P4 of the display surface 1011B in the main display 1010B is positioned lower than the human contact portions (armrest 1026 and control panel 1027). As a result, the height of this gaming machine can be reduced compared with the conventional gaming machines without reducing the size of the displays. Accordingly, the player's visual range can be made larger, precluding the feelings of pressure from the gaming machine on the player thereat.

The fifth straight line and the first straight line intersect further backward in the cabinet 1002 than the lower end P4 of the display surface 1011B of the main display 1010B. Thus, the human contact portions do not obstruct the player's visual range when he/she looks at the display surface 1011B. Accordingly, an excellent visual range can be ensured for the player with respect to the display surface 1011B.

Three raised portions 1042 through 1044 are formed on the upper surface 1041 of the connecting surface 1028. The raised portions 1042 through 1044 are each formed in a curved shape parallel with respect to a width direction of the slot machine 1001. The arc-like portions of the raised portions 1042 through 1044 face the armrest 1026 and the control panel 1027. Thus, if a foreign object such as a coin, dust or the like falls from the human contact portions onto the display, the foreign object is stopped by these raised portions. Accordingly, the player or the staff can easily collect the coin or dust which has fallen from the human contact portions. Also, if liquid such as drinking water or the like which is placed on the human contact portions falls from the human contact portions onto the display, the liquid which has fallen will be temporarily stopped by the raised portions 1042 through 1044. Then, the liquid will flow to the side of the gaming machine along the arc-like shape of the steps 1042A through 1044A. Thus, the liquid can be prevented from entering inside the cabinet.

The present invention is not limited to the above-described embodiments, and it is obvious that various improvements and modifications can be made thereto without departing from the spirit of the present invention.

Figure 15:
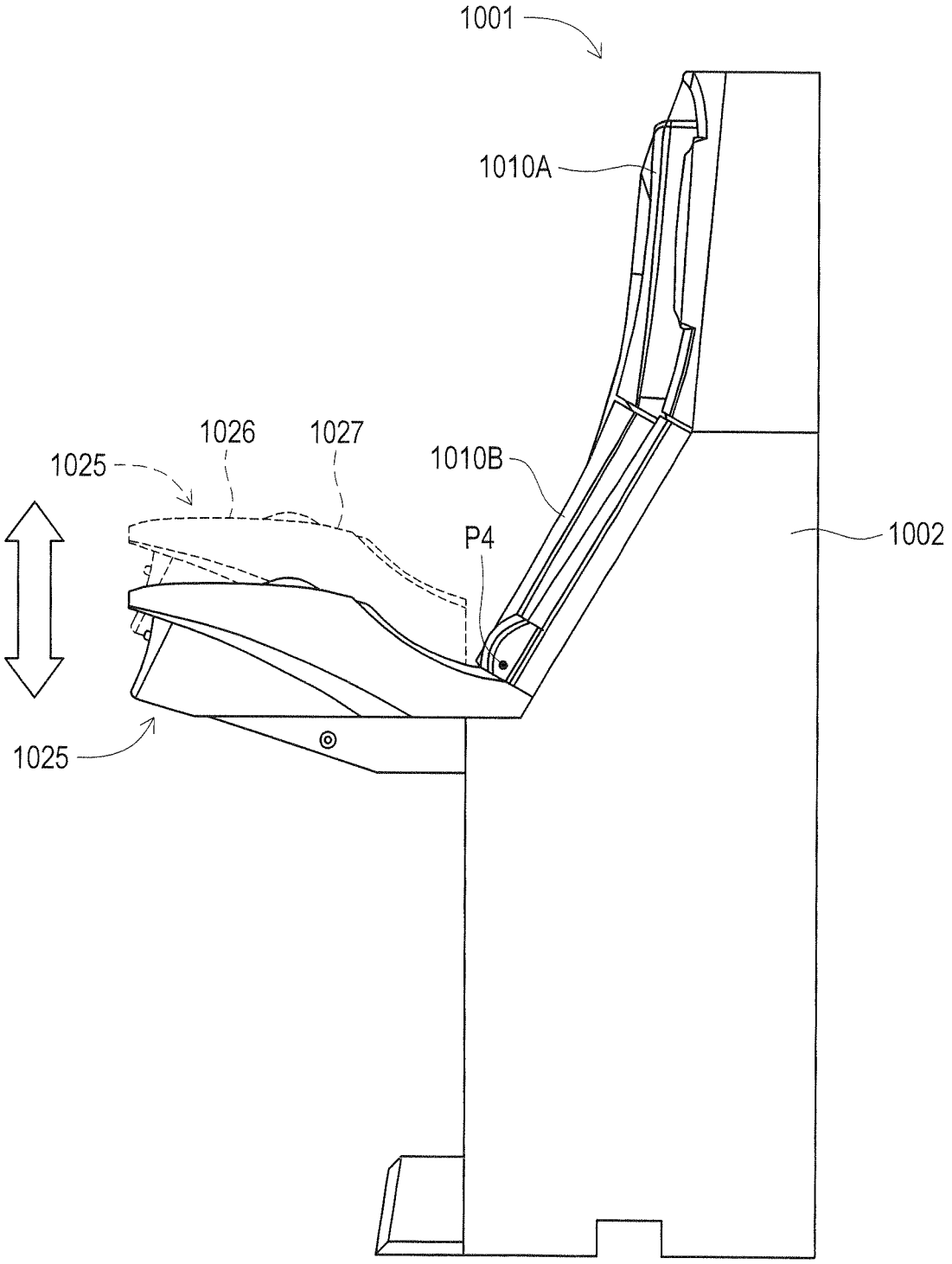
FIG. 15 is a side view showing an outer appearance of a slot machine according to another embodiment of the present invention.

For instance, the slot machine 1001 may also have a moving device for allowing the frontward projecting portion 1025 to move up and down with respect to the cabinet 1002. For instance, when the player operates the operation buttons provided in the control panel 1027, the frontward projecting portion 1025 may move upward or downward in response to the player's operation. With the above-described configuration, the human contact portions (armrest 1026 or control panel 1027) arranged in the frontward projecting portion 1025 as shown in FIG. 15 may be movable in an upward and downward direction with respect to the cabinet 1002. As a result, the human contact portions (armrest 1026 and control panel 1027) can be arranged at a position in accordance with the player's body frame. The slot machine 1001 may detect the player's body frame using a sensor, and the frontward projecting portion 1025 may be automatically moved to a position in accordance with the player's body frame as detected.

Preferably, the frontward projecting portion 1025 may be allowed to move within a range wherein the human contact portions (armrest 1026 or control panel 1027) are positioned higher than the lower end P4 of the display surface in the main display 1010B.

The frontward projecting portion 1025 may be allowed to move pivotally with respect to the cabinet 1002 so that the human contact portions (armrest 1026 and control panel 1027) may be movable upward and downward.

In the slot machine 1 according to the present embodiment, have the armrest 26 and the control panel 27 corresponding to the human contact portions. But, the slot machine 1 may have a coin slot formed on the frontward projecting portion 25 corresponding to the human contact portions in place of the armrest 26 and the control panel 27.

A first straight line 1081 may define a line which connects a point which comes in contact with a player's elbow, in the human contact portions (armrest 1026 and control panel 1027), with the lower end P4 of the display surface 1011B in the main display 1010B, on a vertical section perpendicular with respect to the width direction of the slot machine 1001.

Although the embodiments of the present invention were described above, they were just illustrations of specific examples, and hence do not particularly restrict the present invention. A specific configuration and the like are appropriately changeable in terms of design. Further, the effects described in the embodiments of the present invention are just recitations of the most suitable effects generated from the present invention. The effects of the present invention are thus not limited to those described in the embodiments of the present invention.

Further, the foregoing detailed descriptions centered the characteristic parts of the present invention in order to facilitate understanding of the present invention. The present invention is not limited to the embodiments in the foregoing specific descriptions but applicable to other embodiments with a variety of application ranges. Further, terms and phrases in the present specification were used not for restricting interpretation of the present invention but for precisely describing the present invention. It is considered easy for the skilled in the art to conceive other configurations, systems, methods and the like included in the concept of the present invention from the concept of the invention described in the specification. Therefore, it should be considered that recitations of the claims include uniform configurations in a range not departing from the range of technical principles of the present invention. Moreover, an object of the abstract is to enable a patent office, a general public institution, an engineer belonging to the technical field who is unfamiliar with patent, technical jargon or legal jargon, and the like, to smoothly determine technical contents and an essence of the present application with simple investigation. Accordingly, the abstract is not intended to restrict the scope of the invention which should be evaluated by recitations of the claims. Furthermore, for thorough understanding of an object of the present invention and an effect specific to the present invention, it is desired to make interpretation in full consideration of documents already disclosed and the like.

What is claimed is:

1. A gaming machine comprising:

a cabinet that houses a processor for executing game-related control;

a display that is arranged on a front face of the cabinet and displays game-related information; and a sticker pasting portion that is formed on the front face of the cabinet so that a sticker with a decorative image is pasted thereon, wherein the sticker pasting portion comprises:

a sticker pasting surface onto which the sticker is pasted;

a raised portion that is formed around periphery of the sticker pasting surface so as to be raised by predetermined height with reference to a surface level of the sticker pasting surface;

a light emitting device that is arranged on a side surface of the display and emits light from the side surface of the display; and a reflector that is arranged so as to face the light emitting device beyond the sticker pasting portion and reflects light emitted from the light emitting device, wherein the sticker pasting surface is situated closer to the front face of the cabinet than a light axis from the light emitting device to the reflector is situated, wherein the light from the light emitting device goes toward the reflector and the sticker pasting surface, wherein the reflector is disposed adjacent to the sticker pasting surface and makes an obtuse angle with the sticker pasting surface, wherein the reflector reflects the light from the light emitting device frontward with respect to the display, wherein the sticker pasting surface is enclosed by the raised portion, and wherein the raised portion between the sticker pasting surface and the reflector is continuous from the reflector, thereby forming a flat surface with the reflector.

2. The gaming machine according to claim 1, wherein the raised portion is raised from the surface level of the sticker pasting surface by height that is higher than thickness of the sticker.

3. The gaming machine according to claim 1, wherein the sticker pasting portion is formed around the display on the front face of the cabinet.

4. The gaming machine according to claim 2, wherein the sticker pasting portion is formed around the display on the front face of the cabinet.

5. A gaming machine comprising:

a cabinet that houses a processor for executing game-related control;

a display that is arranged on a front face of the cabinet and displays game-related information; and a sticker pasting portion that is formed around the display on the front face of the cabinet so that a sticker with a decorative image is pasted thereon;

a light emitting device that is arranged on a side surface of the display and emits light from the side surface of the display; and a reflector that is arranged so as to face the light emitting device beyond the sticker pasting portion and reflects light emitted from the light emitting device, wherein the sticker pasting portion comprises:

a sticker pasting surface that is a surface onto which the sticker is pasted and is situated closer to the front face of the cabinet than a light axis from the light emitting device to the reflector is situated; and a raised portion that is formed around periphery of the sticker pasting surface so as to be raised from a surface level of the sticker pasting surface by height that is higher than thickness of the sticker, wherein the light from the light emitting device goes toward the reflector and the sticker pasting surface, wherein the reflector is disposed adjacent to the sticker pasting surface and makes an obtuse angle with the sticker pasting surface, wherein the reflector reflects the light from the light emitting device frontward with respect to the display, wherein the sticker pasting surface is enclosed by the raised portion, and wherein the raised portion between the sticker pasting surface and the reflector is continuous from the reflector, thereby forming a flat surface with the reflector.

* * * * *